US008287226B1

(12) United States Patent
Westendorf et al.

(10) Patent No.: US 8,287,226 B1
(45) Date of Patent: Oct. 16, 2012

(54) FRONT END LOADER ATTACHMENT AND LOCKING MECHANISM

(75) Inventors: Neal W. Westendorf, Dakota Dunes, SD (US); Joseph W. Langenfeld, Onawa, IA (US)

(73) Assignee: Westendorf Manufacturing Co., Inc., Onawa, IA (US)

( * ) Notice: Subject to any disclaimer, the term of this patent is extended or adjusted under 35 U.S.C. 154(b) by 524 days.

(21) Appl. No.: 12/557,058

(22) Filed: Sep. 10, 2009

(51) Int. Cl.
*E02F 9/00* (2006.01)

(52) U.S. Cl. ..... 414/686; 403/321; 403/322.4; 403/325; 172/274

(58) Field of Classification Search ..... 414/680, 414/686; 403/321, 322.4, 325, 322.1; 172/272–275
See application file for complete search history.

(56) References Cited

U.S. PATENT DOCUMENTS

| | | | | |
|---|---|---|---|---|
| 3,805,980 | A | 4/1974 | Kisaka | 414/686 |
| 4,318,662 | A | 3/1982 | Erickson | 414/686 |
| 5,360,313 | A | 11/1994 | Gilmore | 414/694 |
| 5,388,950 | A | 2/1995 | Schmahl | 414/686 |
| 5,535,533 | A | 7/1996 | Romanchok | 37/403 |
| 5,536,134 | A | 7/1996 | Hirooka | 414/686 |
| 5,620,297 | A | 4/1997 | Mahaney | 414/686 |
| 5,895,199 | A | 4/1999 | Baumert | 414/686 |
| 6,035,941 | A | 3/2000 | Hirooka | 172/274 |
| 6,142,724 | A | 11/2000 | Hirooka | 414/686 |
| 6,386,821 | B1 | 5/2002 | Schneider | 414/686 |
| 6,582,177 | B1 | 6/2003 | Westendorf | 414/686 |
| 6,725,583 | B2 | 4/2004 | Sprinkle | 37/468 |
| 7,134,832 | B2 | 11/2006 | Schrepferman | 414/686 |
| 7,172,384 | B1 | 2/2007 | Westendorf | 414/686 |
| 7,549,832 | B2 | 6/2009 | Mailleux | 414/686 |
| 2005/0111953 | A1 | 5/2005 | Westendorf | 414/686 |
| 2005/0281659 | A1 | 12/2005 | Friesen | 414/686 |
| 2006/0045712 | A1 | 3/2006 | Schrepferman | 414/686 |
| 2006/0245899 | A1 | 11/2006 | Lyons | 414/686 |

*Primary Examiner* — Donald Underwood
(74) *Attorney, Agent, or Firm* — Dowell IP

(57) ABSTRACT

A hand-operable connection assembly is described for quickly connecting and disconnecting a vehicle from a boom assembly. The connection assembly includes a tower and a bracket, the tower is rotatably secured to both an actuator and a boom arm while the bracket is secured to a vehicle or construction device. The tower and bracket interconnect via pins that seat in pockets, and the tower is secured or locked to the bracket via a hand-operable locking clevis that rotates about one of the pins and wraps around the curved exterior of one of the pockets. The center point of the exterior curvature is offset from the center point of the clevis rotation such that rotation of the clevis tightens the clevis against the pocket. The pins may be located at the two hinges connecting the boom arm and actuator to the tower, or the pins may be separated from the hinges. The exterior of the pocket may include a grind sheet designed to scrape against and secure a grind bar of the locking clevis in a locked configuration. The clevis is structured such that if the pin moves around in the pocket while in use by the vehicle, the weight of the grind bar will cause the clevis to rotate to a more locked configuration. The connection assembly may also include a spring, lever, or torque bar to assist in unlocking the assembly if the clevis becomes over-tightened.

23 Claims, 20 Drawing Sheets

FIG. 3
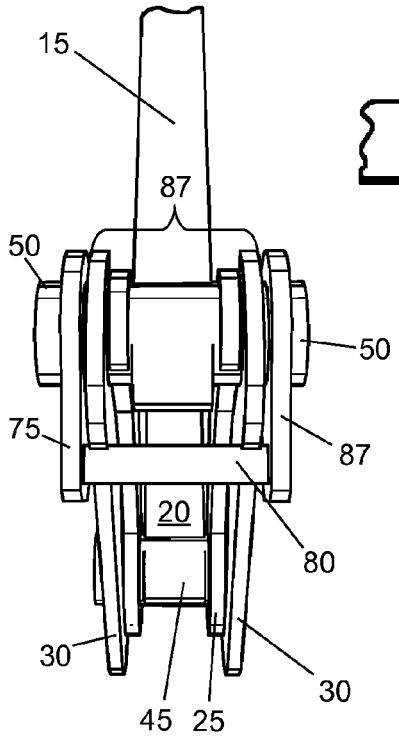
FIG. 4
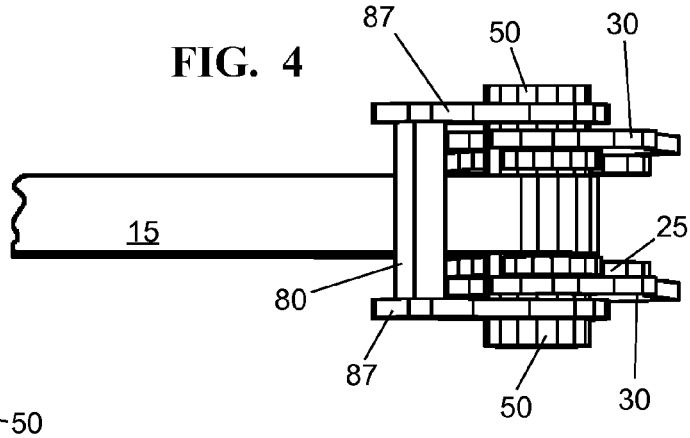
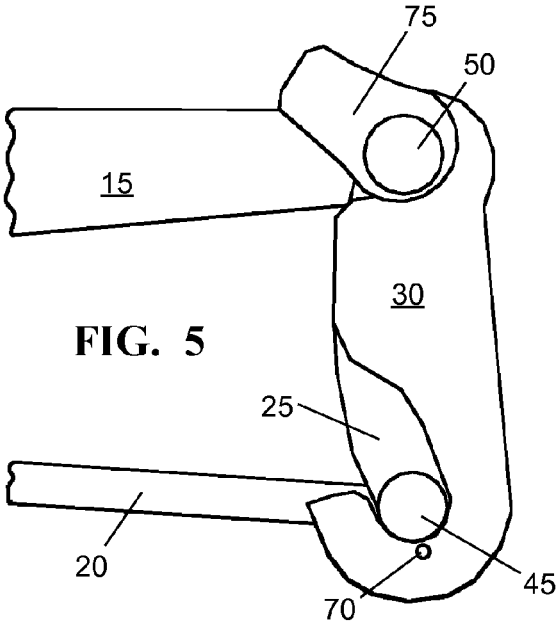
FIG. 5
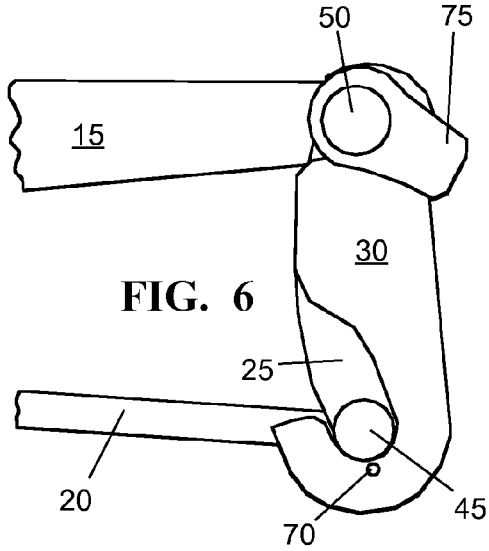
FIG. 6

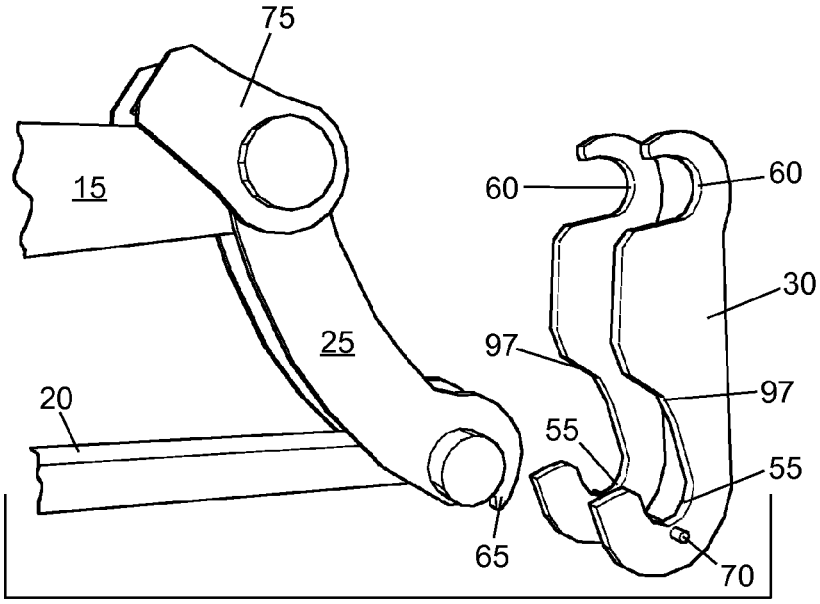
FIG. 8
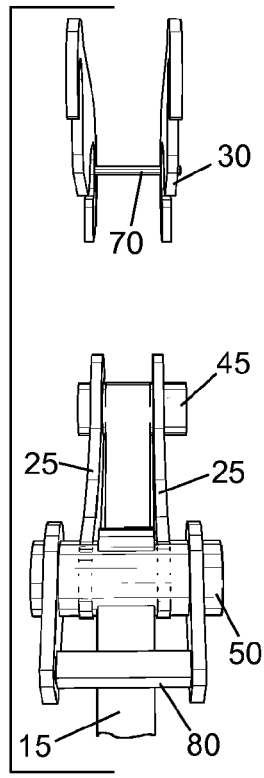
FIG. 9
FIG. 10
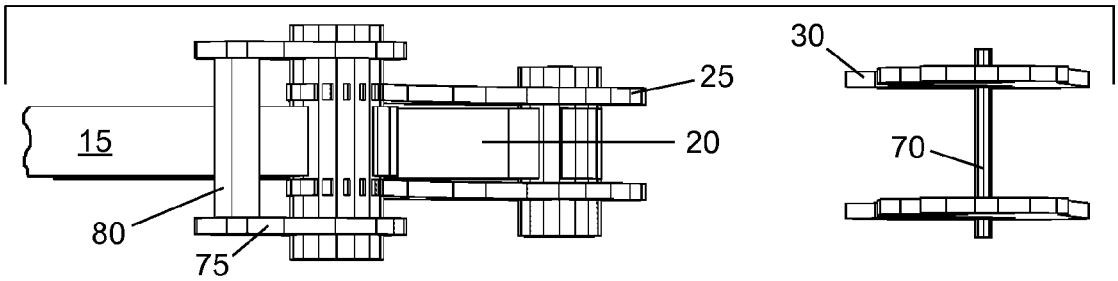

FIG. 25
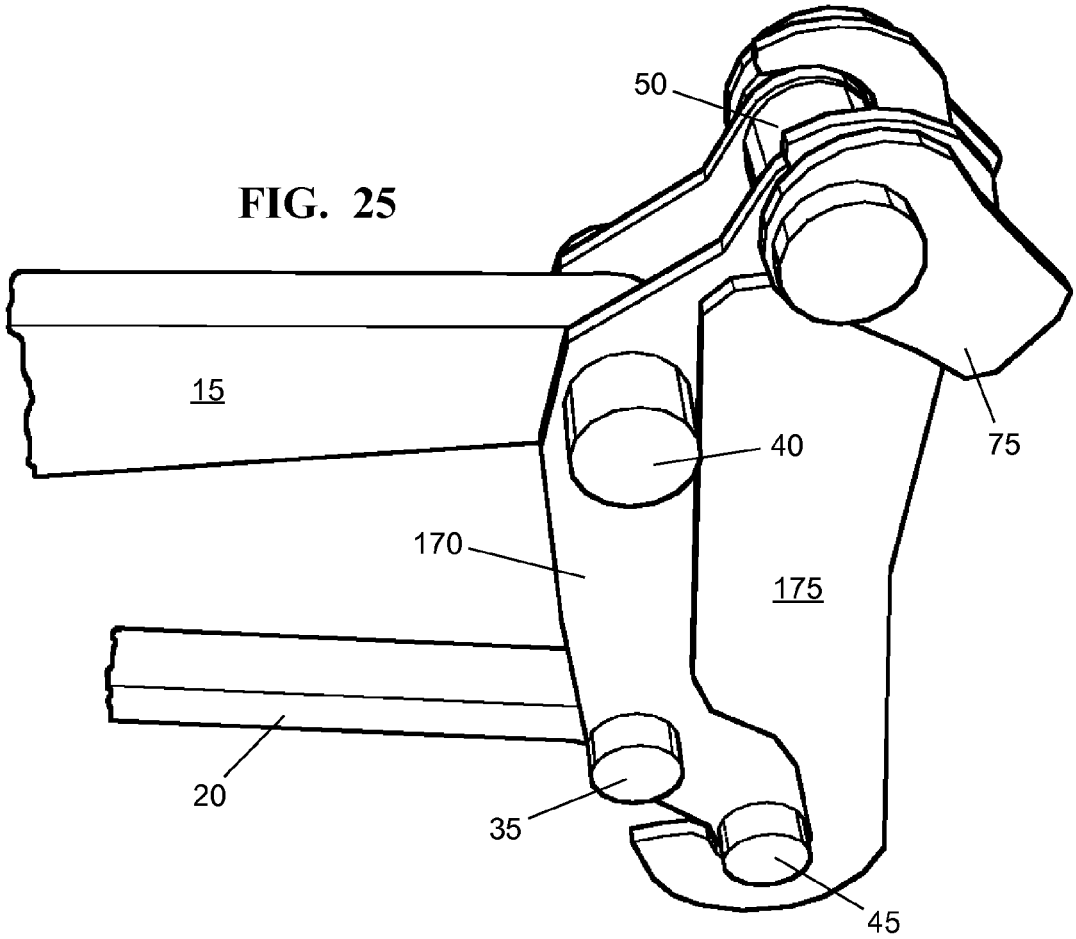
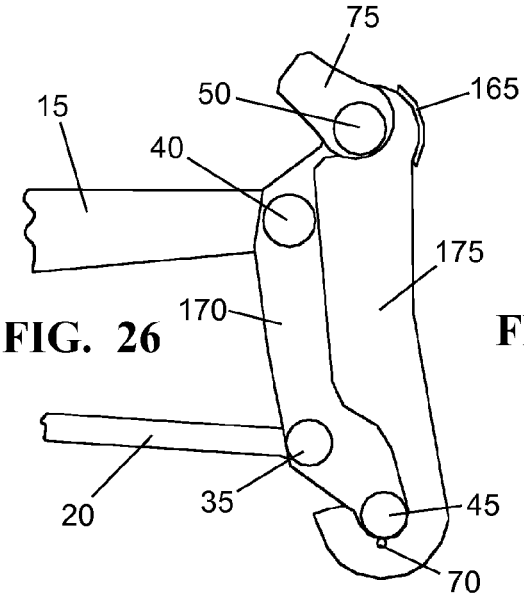
FIG. 26
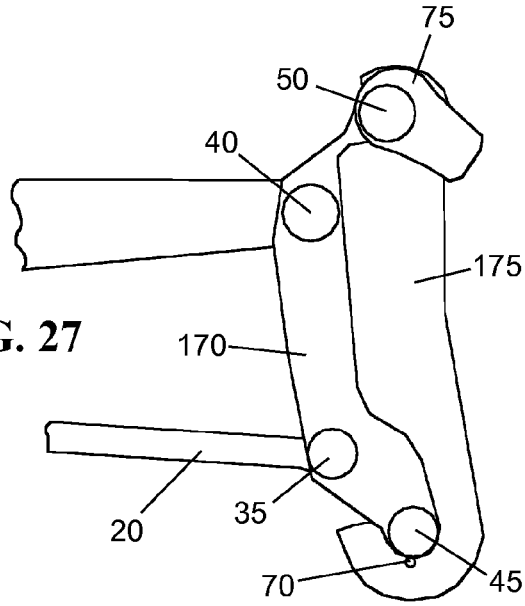
FIG. 27

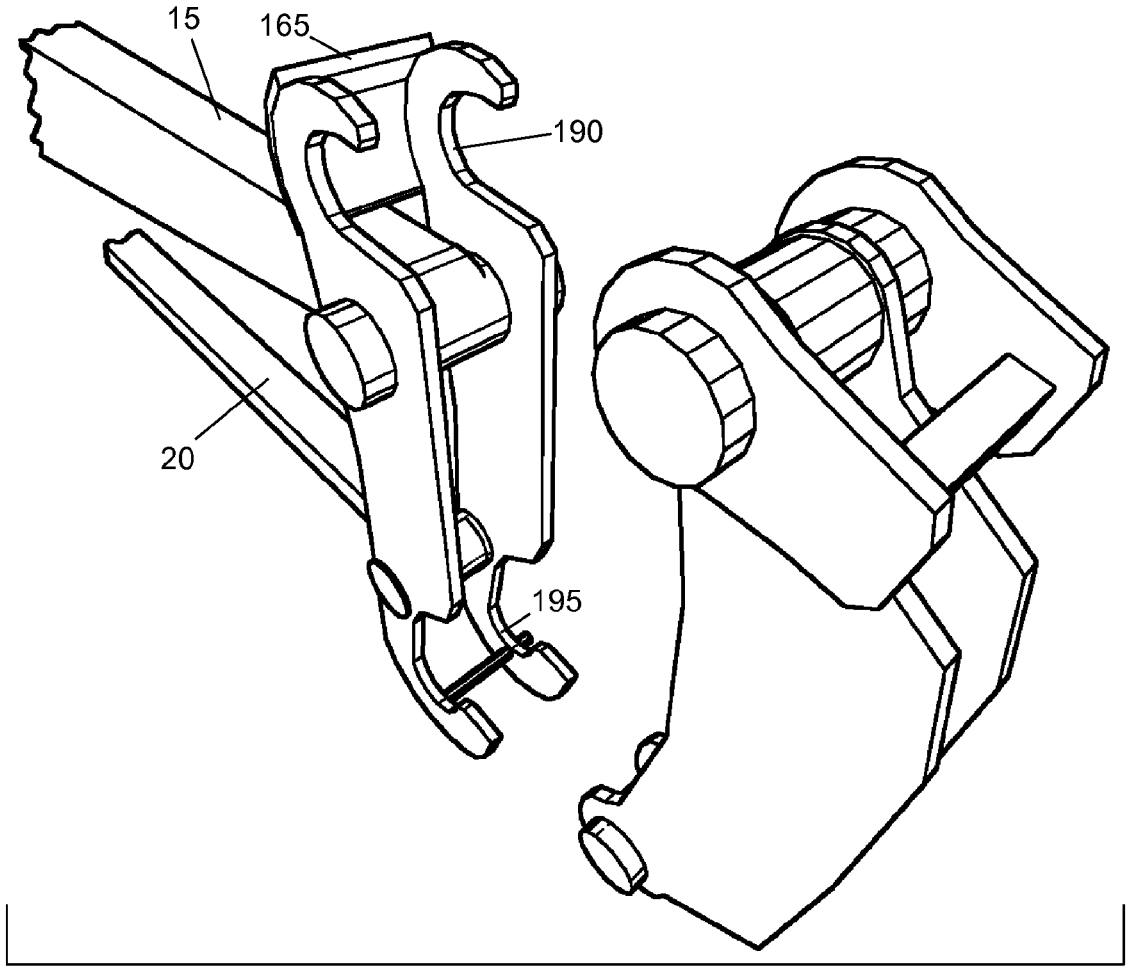
FIG. 30
FIG. 31
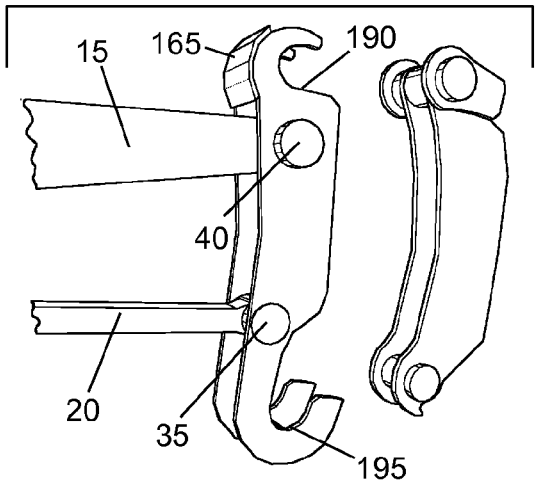
FIG. 32
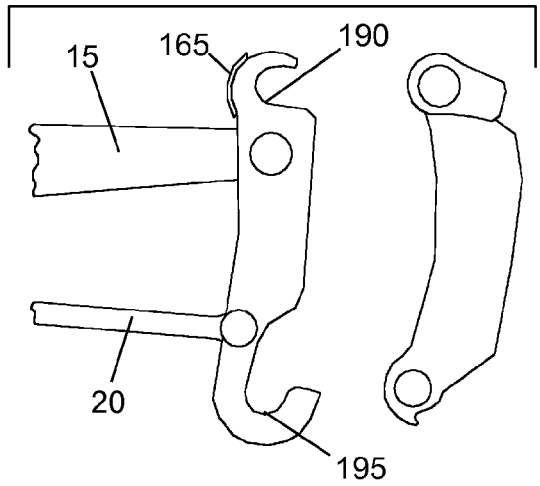

FIG. 42
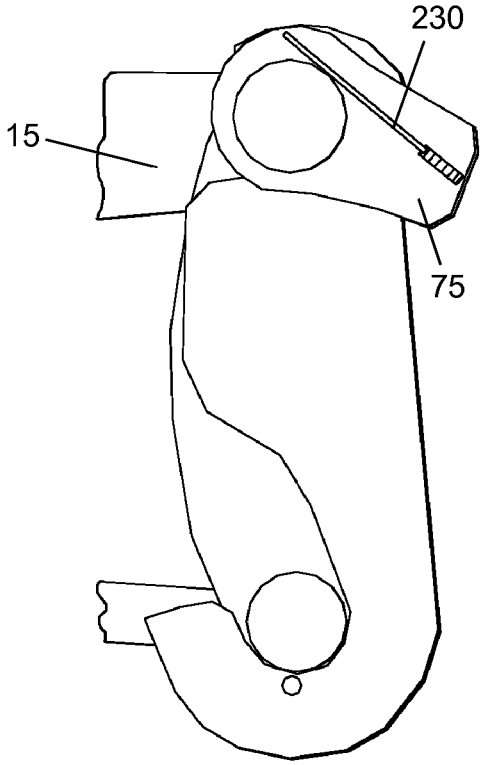
FIG. 43
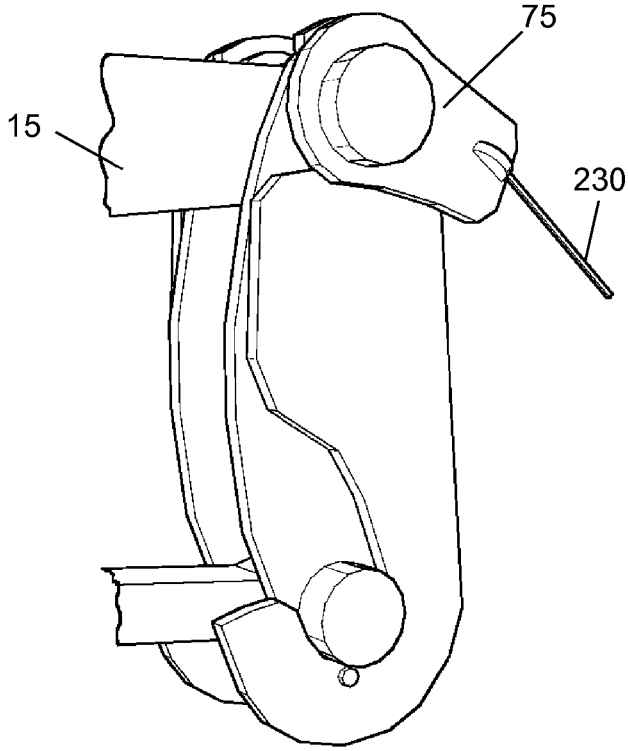
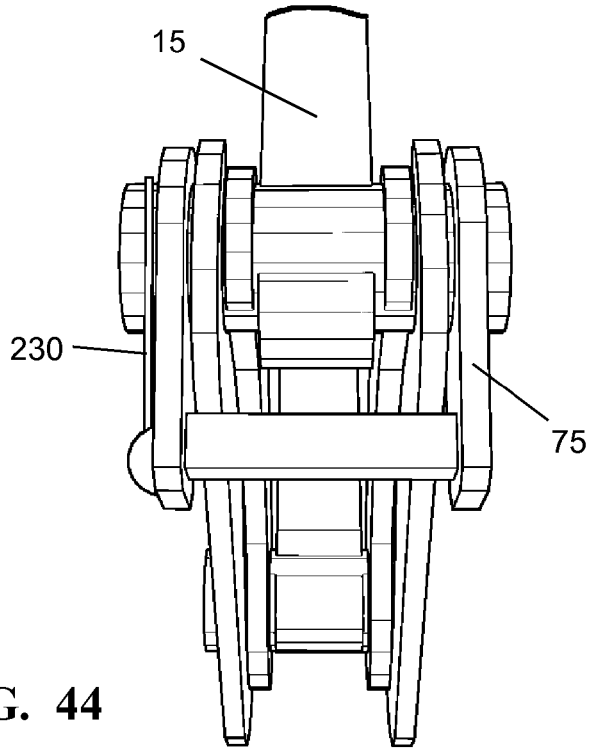
FIG. 44

FRONT END LOADER ATTACHMENT AND LOCKING MECHANISM

The present invention relates generally to connections between vehicles and lifting booms, and more specifically to hand-operable assemblies that lock lifting arms onto tractors or construction machinery.

BACKGROUND OF THE INVENTION

Tractors are a common utility vehicle in the farming, construction and landscaping industries. The key benefit of these vehicles is their great versatility. Unlike vehicles dedicated to a specific task, a wide variety of implements and equipment can be attached to and operated by a tractor including loaders, plows, snow throwers, mowers, grappling claws, post hole diggers, forks, bale spears, trenchers, hay balers, cultivators, spreaders and graters, to name a few. In order to efficiently use this wide variety of implements and equipment with a single tractor, however, such implements and equipment must be capable of quick attachment and removal from the tractor, and safe storage when other equipment or implements are being used with the tractor. Accordingly, owners and operators of tractors are constantly seeking new and improved methods and configurations for implements that allow for their quick and safe removal, attachment and storage.

The front end loader is a common implement found on most utility tractors, and its removal, attachment and storage presents specific challenges. The front end loader includes a bucket or scoop that is attached to the end of two lift arms that extend from the front of the tractor, and hydraulic cylinders that connect to the hydraulic system of the tractor to raise and lower the lift arms and rotate the bucket. The front end loader is primarily used to lift, load and transport all types of material including dirt, rocks, feed, sand, gravel, wood and snow. The bucket may also typically be detached from the lift arms so that other implements, such as grappling claws, forks or bale spears, may be attached in place of the bucket and operated by the tractor.

Although useful in many applications, it is often desirable for the operator of a tractor to remove the front end loader from the tractor. When operating an implement or equipment attached to the rear of the tractor, for example, the front end loader may reduce the maneuverability of the vehicle, add unnecessary weight to the vehicle and impair the visibility of the operator. Accordingly, an operator may frequently wish to remove the front end loader from the tractor and, later, reinstall the front end loader on the tractor. Many types of connectors, mechanisms and attachments have been developed to safely, quickly and securely attach a front end loader to a tractor.

A front end loader is typically installed on a heavy duty bracket assembly bolted to and extending up both sides of the tractor. The front end loader includes a tower at the rear end of each lift arm that is attached, near the top, to the lift arm and, lower on the tower, to the lift cylinder. To attach the front end loader to the tractor, the tractor is driven between the lift arms of the front end loader so that the towers at the rear of each lift arm are immediately adjacent to the bracket assembly on each side of the tractor. The hydraulic lines of the front end loader are then connected to the hydraulic system of the tractor. With the hydraulic lines connected, the height and orientation of the towers can be changed by extending and retracting the lift cylinders and implement cylinders of the front end loader. The towers are then engaged with the bracket assembly by manipulating the height and orientation of the towers and/or moving the tractor forward, or some combination of the two.

When precisely matched with the bracket assembly, each tower can then be attached and secured to the bracket on both sides of the tractor. The simplicity of the mechanism and the ease with which the tower is aligned with and secured to the bracket assembly largely determines the time necessary for the front end loader to be removed from and, later, reinstalled on the tractor.

A common prior art connection and method for attaching the tower to the bracket assembly is a heavy duty pin that is inserted though the bracket assembly and each tower and secured in place. To utilize this prior art connection, each tower is lowered onto a seat or groove on the bracket assembly. With the lower end of the towers engaged with the bracket assembly, the towers are then rotated backwards and forwards until a hole in each tower perfectly aligns with holes in the bracket assembly. The heavy duty pin is then inserted through the holes to lock the towers into the bracket assembly, and the pin is then locked in place through a variety of means, such as, for example, a cotter pin through the heavy duty locking pin.

Although relatively simple in operation, this connection presents certain challenges and disadvantages. First, it may be difficult to seat the towers in the bracket assembly to begin the process. Second, the holes of the towers and the bracket assembly must be precisely aligned for the pin to slide easily through the holes. Third, the alignment of the holes cannot typically be determined from the operator's seat on the tractor, and the operator must dismount the tractor to determine if the holes are aligned before attempting to insert the pin. Also, the pins cannot typically be inserted from the operator's seat.

If the tractor itself is not aligned perfectly straight between the lift arms, the holes in the towers and the bracket assembly will not properly align. This problem will often not be evident until an operator has placed the tractor between the lift arms, and then attempted to manipulate the position of the towers to align with the brackets, and then dismounted from the driver's seat of the tractor to attempt to insert the pins. When a single operator is attempting to install the front end loader, the operator must often mount and dismount the tractor multiple times, often moving the tractor and the towers in the process, before the pins can be properly aligned. This process takes time, and can be difficult for a novice operator.

In addition, the pins and the holes can become worn over time, leading to a loose connection between the front end loader and the bracket assembly. This loose connection can lead to issues when the loader is operated if the towers are not securely fixed in the bracket assembly. Pins can also be lost or misplaced when the front end loader is stored.

Further, to remove the front end loader from the tractor, an operator must place the implement on the ground and then manipulate the lift and rotation hydraulic cylinders until no force is exerted on the pins by the towers and bracket assembly. If the pin is even only slightly bound to the towers and bracket assembly, an operator must use great strength to remove the pin, or employ a tool to pry the pin from the holes.

Typically, the operator must dismount the tractor to determine if the pins are sufficiently loose for removal. Alternatively, the operator may stand on the side of the tractor and manipulate the front end loader hydraulics until the pin on the side on which the operator standing is loose and can be removed. The pin on the other side of the tractor, however, may still be bound, requiring the operator to run around the tractor, alternatively manipulating the hydraulics and attempting to remove the other pin. Again, this process takes time, and can be difficult for a novice operator.

Thus, although the locking pin mechanism has received widespread use, owners and operators have sought improved configurations and methods for securing a front end loader to a tractor that improve the connection between the loader and the bracket assembly and provide an easier means for a single operator to attach and remove a front end loader without dismounting the tractor.

Accordingly, an object of the present invention is to provide a front end loader configuration and method for attachment and removal that allows the front end loader to be quickly and simply attached and removed from a utility tractor.

A further object of the present invention is to provide a front end loader configuration and method for attachment and removal that does not require the use of tools to attach and remove the front end loader from the tractor, or pins or other attachment devices that can be lost.

Yet another object of the present invention is to provide an attachment device that automatically locks loader arms to a vehicle when the arms are brought into contact with the vehicle.

Finally, an object of the present invention is to provide a front end loader configuration and method for attachment and removal that allows an operator to attach and remove the front end loader without leaving the seat of the tractor, and that allows an operator to determine visually whether the front end loader has been securely connected to the tractor.

SUMMARY OF THE INVENTION

A self-contained hand-operable connection assembly is described for easily attaching and removing lifting arms from a vehicle. The connection assembly includes integral, self-tightening and hand-operable locking mechanisms that securely attach the towers of the lifting arms to the bracket assembly of a tractor. The connection assembly allows an operator to quickly remove and connect the lifting arms to the tractor without leaving the seat of the tractor. Additionally, the design of the assembly does not hinder the maneuverability of the vehicle, add unnecessary weight to the vehicle, or impair the visibility of the operator.

The connection assembly of the present invention includes a tower and a bracket. The tower is secured to both a hydraulic actuator and a boom arm. The bracket is rigidly secured to the vehicle. The assembly includes horizontally extending pins structured to interconnect or seat in matching pockets when the tower and bracket are interconnected. The openings of the pockets are oriented such that the pins may only be seated or removed in a predetermined sequential method. When connecting the tower to the bracket, a first pin must be seated before a last pin is seated. Conversely, the last pin must be removed from its pocket before the first pin can be removed. For securing the tower to the bracket, a hand-operable U-shaped locking clevis locks the last pin into its pocket and thus secures all other pins in their respective pockets.

The U-shaped locking clevis has rotors that are secured to, and rotate about the last pin. A grind bar, of the clevis, is secured to the rotors and is structured to frictionally lock the clevis in a configuration for securing the tower and bracket. The U-shaped clevis is structured to wrap around and secure a portion of the last pocket between the grind bar and the last pin. Rotation of the clevis pushes the grind bar against the exterior of a hook forming the pocket for the last pin and thus pushes the last pin into its pocket. As the grind bar is rotated, it frictionally scrapes against the exterior curvature of the hook and thus prevents the clevis from accidentally rotating to a position where the pins may be removed from their pocket.

The center point of the exterior curvature of the hook is offset from the center point of the clevis rotation so that rotation gradually tightens the clevis against the pocket. In an exemplary example of the invention, when the tower and bracket are interconnected, the locking clevis is positioned near the vehicle operator's seat so that the assembly can be quickly disconnected.

The exterior of the pockets may include grind sheets designed to scrape against and secure the grind bar of the clevis in a locked configuration. The clevis may be structured such that if the pin moves around in the pocket while in use by the vehicle, the weight of the grind bar will cause the clevis to rotate to a more locked configuration. The connection assembly may also include a spring, lever, or torque bar to assist in unlocking the assembly if the clevis becomes over-tightened. The spring, lever, and torque bar are preferably integrated into the assembly.

In order to assist an operator in aligning the pins to the pockets, the pockets may include guide sections that direct the pins towards the pockets. By having to align the pins with larger guide sections, instead of smaller pockets, the amount of skill and time needed to align the pins in the pockets is decreased.

The pins of the assembly may be located at the hinges connecting the boom arm and actuator to the tower, or the pins may be distant from the hinges. The pins may be located on either the bracket or the tower, while the pockets are located on the other of the bracket or the tower.

These and other advantages will become apparent as this specification is read in conjunction with the accompanying drawings and appended claims.

BRIEF DESCRIPTION OF THE DRAWINGS

FIG. 3 shows a front view of a lift arm tower secured to a vehicle bracket by a locking clevis and a hook.

FIG. 4 shows a top view of a lifting arm tower seated in the pockets of a bracket.

FIG. 5 shows a side view of a lift arm seated in, but not secured to, a vehicle bracket.

FIG. 6 shows a side view of a lift arm seated in, and secured to, a vehicle bracket by a hand-operable locking clevis.

FIG. 8 shows a side perspective view of a lifting boom coupler disconnected from a vehicle receiver.

FIG. 9 shows a back perspective view of a lifting boom coupler disconnected from a vehicle receiver.

FIG. 10 shows a top view of a connection assembly with a lifting boom tower disconnected from a vehicle receiver.

FIG. 25 shows a side view of a tower secured to a bracket wherein the bracket pins of the tower are located distant from the lift arm and cylinder hinges.

FIG. 26 shows a side view of the assembly of FIG. 25 wherein the tower pins are seated in the pockets of the bracket, and the tower is not secured to the bracket by the hand-operable locking clevis.

FIG. 27 shows a side view of the assembly of FIG. 25 wherein the tower pins are seated in the pockets of the bracket, and the tower is secured to the bracket by the hand-operable locking clevis.

FIG. 30 shows a front perspective view of a lifting arm tower with pockets structured to seat and secure vehicle pins of a vehicle bracket.

FIG. 31 shows a rear perspective view of a lifting arm tower with pockets structured to seat and secure vehicle pins.

FIG. 32 shows a side view of a lifting arm tower with pockets structured to seat and secure vehicle pins.

FIG. 42 shows a side view of a tower and bracket assembly with a torque bar in a storage configuration, wherein the torque bar provides additional leverage to an operator locking or unlocking the clevis from around the bracket.

FIG. 43 shows a side view of a tower and bracket assembly with a torque bar in an operational configuration, wherein the torque bar provides additional leverage to an operator locking or unlocking the clevis from around the bracket.

FIG. 44 shows a rear view of a tower and bracket assembly with a torque bar in a storage configuration, wherein the torque bar provides additional leverage to an operator locking or unlocking the clevis from around the bracket.

The drawings are not necessarily to scale and certain details unnecessary for an understanding of the present invention have been omitted. The invention is not limited to the particular embodiments illustrated herein.

DETAILED DESCRIPTION

The present invention may be used with any type of implement lift arm assembly used with a vehicle for lifting and operating an implement. The preferred embodiment of the present invention, however, will be described herein for use with a front end loader. Those of skill in the art will recognize that the present invention may be used or adapted for use with any type of implement lift arm assembly. Further, although removable front end loaders are typically used with tractors, front end loaders are also used with other types of vehicles, including most notably skid steers, and the inventions disclosed herein may be used with these other types of vehicles.

Those of skill in the art will recognize that the present invention is equally adaptable for use with other utility vehicles and construction machinery. Thus, the present invention is not limited to only front end loaders, nor is it limited to loaders used in connection with tractors, but is applicable to the removal and storage of any type of lift arm assembly used in connection with any type of vehicle.

Figure 1:
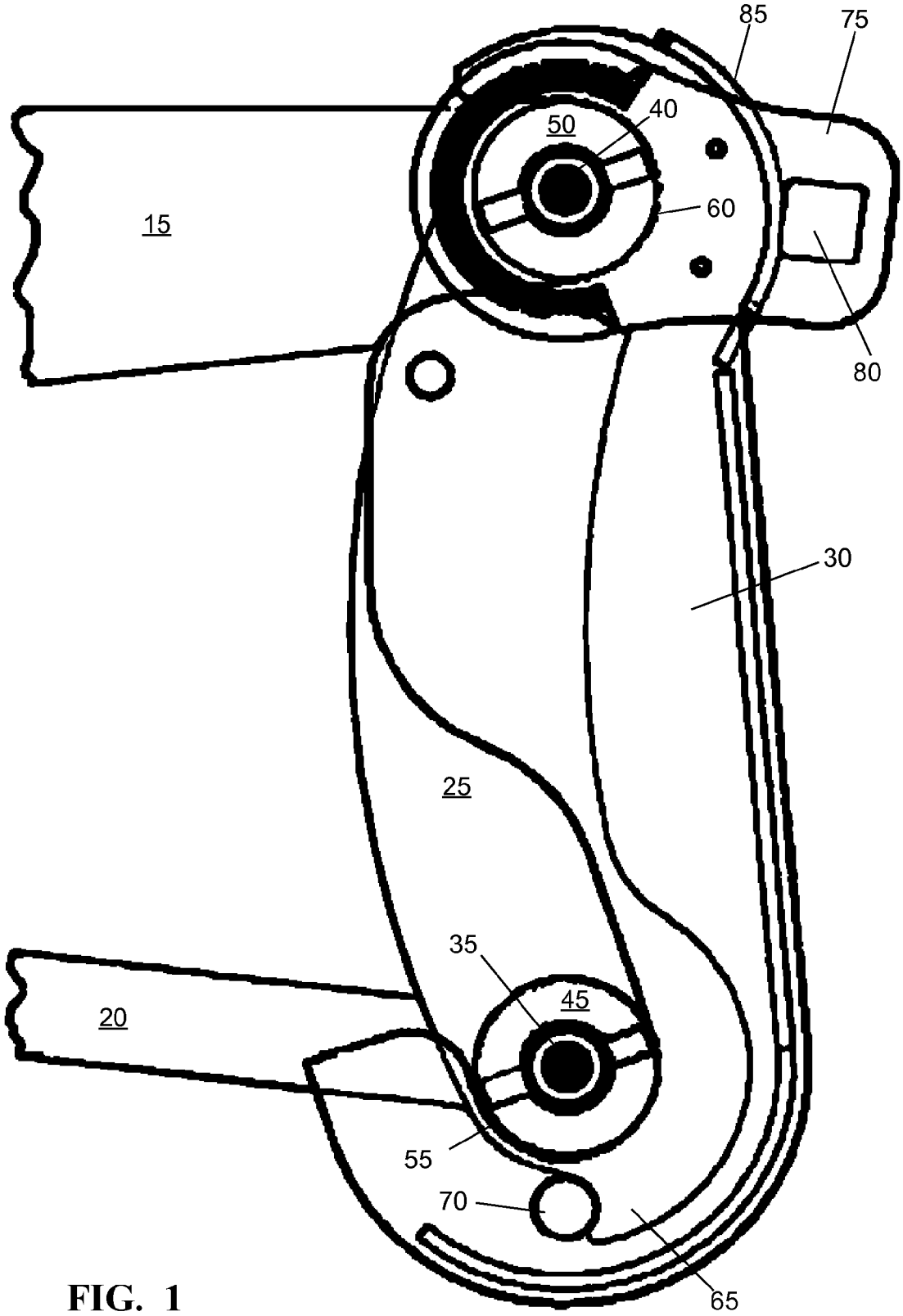
FIG. 1 shows a side view of a lift arm secured to a vehicle bracket by a locking clevis wrapping around the exterior of a pocket.

FIG. 1 illustrates a lift arm 15, a lift cylinder 20, and a connection assembly with a tower 25 or coupling secured to the bracket 30 or adapter of a vehicle. In the illustrated example, the lift cylinder is rotatably (or hingeably) connected to the tower at a lower hinge 35 and the loader arm is rotatably connected to the tower at an upper hinge 40. Secured about the lower hinge 35 is a lower pin 45 and secured about the upper hinge 40 is an upper pin 50. The lower and upper pins are structured so that they seat in a lower pocket 55 and an upper pocket 60 of the bracket 30, respectively. The illustrated upper and lower pockets both are formed as part of hook structures that have curved interior surfaces forming the pockets and curved exterior surfaces.

The tower 25 includes a locking fastener 65 that is located outside of the lower pocket, but near the lower hinge of the tower, that rotates and secures to a locking bar 70 of the vehicle bracket. When the lower pin 45 of the tower is located within the lower pocket 55 of the bracket 30, the locking fastener 65 acts to keep the lower pin within the pocket. The locking fastener 65 is rotationally locked about the lower pin relative to the upper pin. For example, if the fastener rotates 20 degrees clockwise about to the lower pin, the upper pin will also rotate 20 degrees clockwise about to the lower pin. On the upper hinge of the tower is located a U-shaped locking clevis 75 that may be rotates about, is connected to, and may be used to secure the upper pin of the tower within the upper pocket of the bracket. The locking clevis rotates about the upper pin of the tower and includes a locking bolt 80, or grind bolt/bar, that is structured to wrap around and be secured to the exterior or a grind plate 85 of the bracket.

Figure 2:
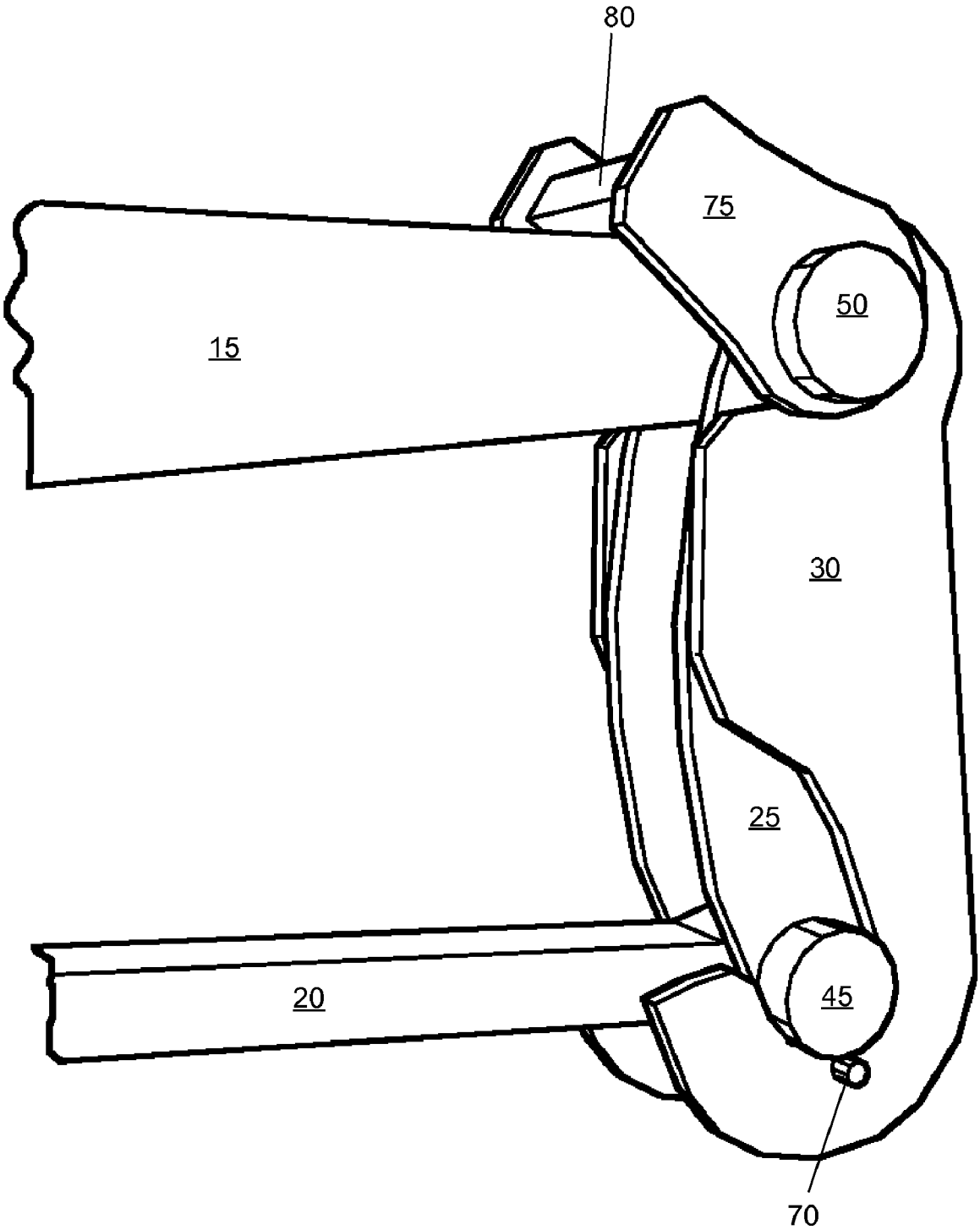
FIG. 2 shows a perspective view of a lifting arm tower seated in the pockets of a bracket.

FIGS. 2, 3, and 4 show side perspective, rear perspective, and top views of the assembly of FIG. 1. The tower 25 in the illustrated examples is constructed from two substantially parallel plates that each extends from, and rotates about, the upper pin 50 and the lower pin 45. A portion of both the lift arm 15 and the lift cylinder 20 is flanked by the parallel plates such that lateral rotation of the lift arm 15 and the lift cylinder 20 relative to the tower is minimized while vertical rotation is facilitated. Like the tower, the bracket may be constructed from two substantially parallel plates with similar profiles. In the illustrated examples, the width of the bracket hooks is equal to the bracket width, however non-parallel plates may also be used to form the bracket. In the illustrated example the plates of the tower are spaced with a bracket width 86 such that they seat between the plates of the bracket, however in other embodiments, the plates of the tower may wrap around the exterior of the bracket. Alternatively, horizontally oriented plates may be utilized. In FIG. 3, the rotors 87 of the locking clevis flank the plates of the bracket when the tower is seated in and secured to the bracket such that a portion of the bracket hook (forming the upper pocket) is surrounded by the first rotor, the second rotor, the tower, and the grind bar 80. However, rotors of the U-shaped locking clevis may also be located between the plates of both the tower and the bracket. If the rotors have a substantially narrow separation, the grind bar may extend past the rotors such that the grind bar rubs against the bracket when the tower is frictionally secured to the bracket by the locking clevis.

FIG. 5 illustrates a tower seated in, but not secured to a vehicle bracket, while FIG. 6 illustrates a tower seated in, and secured to, a vehicle bracket. In FIG. 5 the hand-operable locking clevis 75 has been rotated counter-clockwise about the upper pin 50 such that the grind bar (not shown in FIGS. 5 and 6) is not in contact with the grind plate or the exterior surface of the bracket. The tower of FIG. 5 is fully seated in the bracket because both the upper and lower pins are located within the respective pockets of the bracket. In FIG. 6, the locking clevis has been rotated forward such that the grind bar scrapes against the upper exterior portion of the bracket. The U-shaped locking clevis is wrapped around the upper portion of the bracket such that the upper pin of the tower cannot be removed from the upper pocket of the bracket. Due to the construction of the bracket, the lower pin cannot be removed from the bracket until the upper pin has been removed from the bracket.

Figure 7:
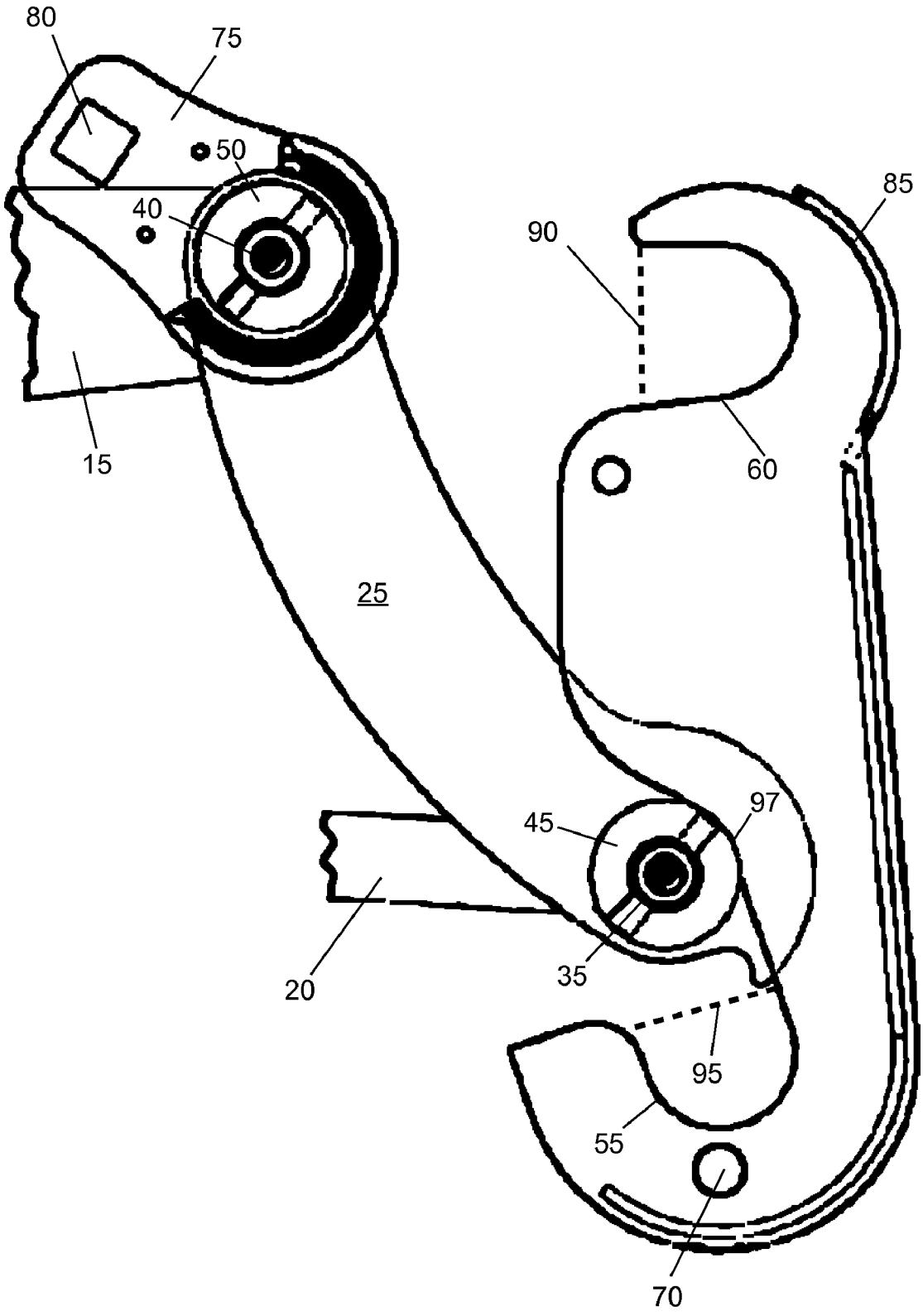
FIG. 7 shows a side view of a dual-pin lift arm tower disconnected from a dual-pocket vehicle bracket.

In the tower and bracket illustrated in FIG. 7, the upper pocket of the bracket has a substantially vertical opening 85, while the lower pocket has a substantially horizontal opening 90. FIGS. 7-10 show a tower 25 being secured to a vehicle bracket. Due to the shape of the lower pocket 25, the lower pin 45 must be secured in the lower pocket 55 before the upper pin 50 can be secured. Conversely, the lower pin 45 cannot be removed through the horizontal opening 95 of the lower pocket 55 without the upper pin 40 first being removed from the upper pocket 60. Thus, only one locking clevis is needed to secure both the hinges in both of the pockets and the pins of the tower must be removed from or seated in the pockets in a sequential method.

In FIG. 7, the lower pin 45 of the tower is pressed against a guide portion 97 of the bracket that is structured to direct the lower pin down into the lower pocket as the tower is moved closer to the bracket. With the guide portion 97, the vertical alignment tolerances for aligning the bracket and tower are increased thereby making it easier and faster for an operator to connect the tower and bracket. In the illustrated example, the guide portion is a section of bracket that slopes towards the lower pocket, however other configurations, such as a ratcheting structure may be used and are within the scope of the present invention.

In FIGS. 1-10, the upper pin is shown with a hand-operable locking clevis, however an assembly having a locking clevis secured to, and rotatable about, the lower pin is within the scope of the present invention.

Figure 11:
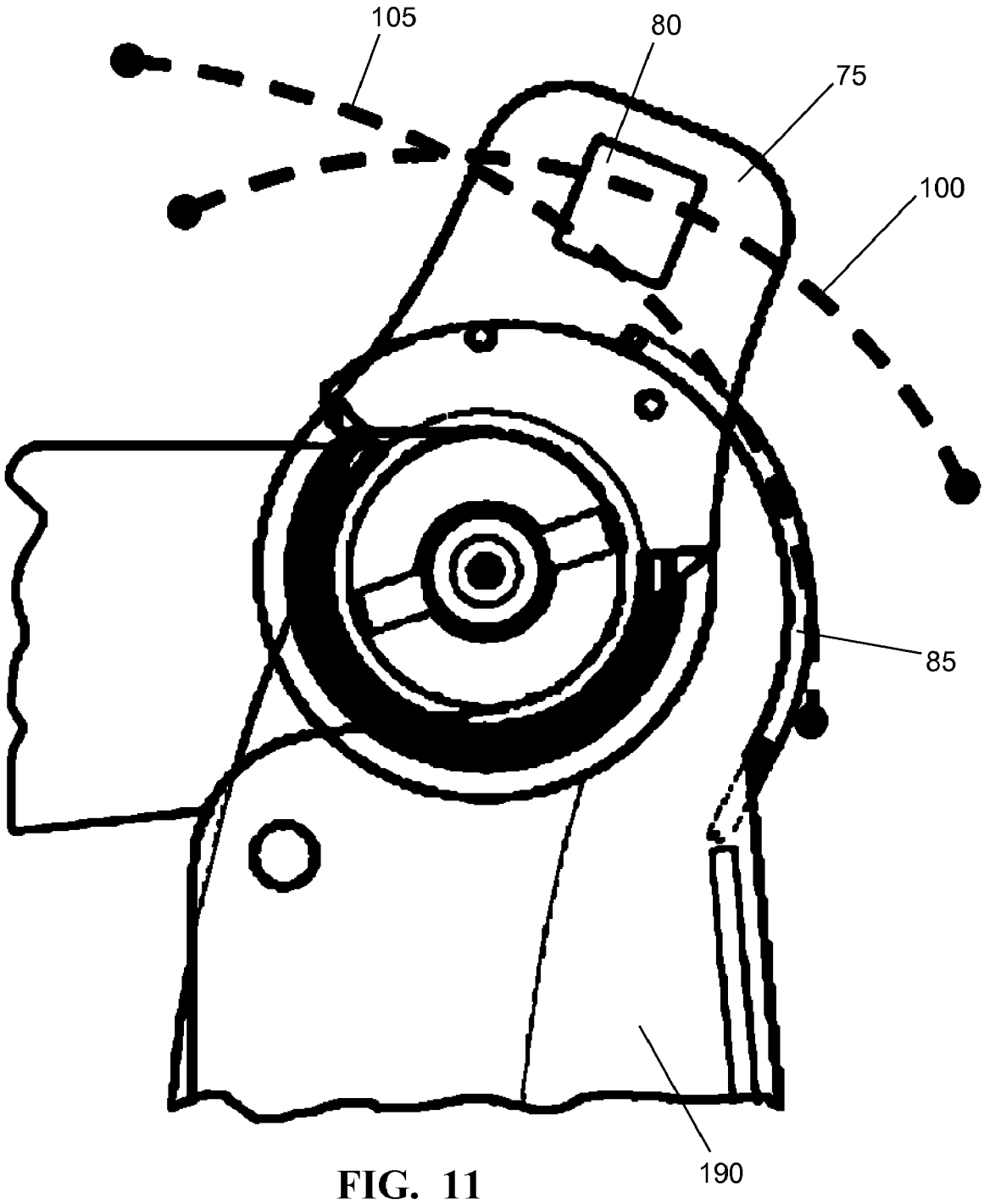
FIG. 11 shows a close-up view of a locking clevis highlighting the difference in the rotation of the clevis and the curvature of the bracket.

FIG. 11 highlights the locking clevis of FIG. 1. In the illustrated example, the arc of rotation 100 of the clevis locking bolt is different from the exterior curvature 105 of the bracket. As the locking clevis 75 is rotated forward, the locking bolt 80, or grind bolt, presses against a grind plate 85, or the curved exterior surface of the vehicle bracket. The further the clevis 75 is rotated, the more the locking bolt 80 presses against the grind plate 85 to secure the U-shaped locking clevis in a locked configuration. The locking bolt may also be weighted such that if during operation of the vehicle and assembly the upper hinge shakes within the upper pocket, the weight of the locking bolt will force the clevis downwards into an even more secure orientation.

Figure 12:
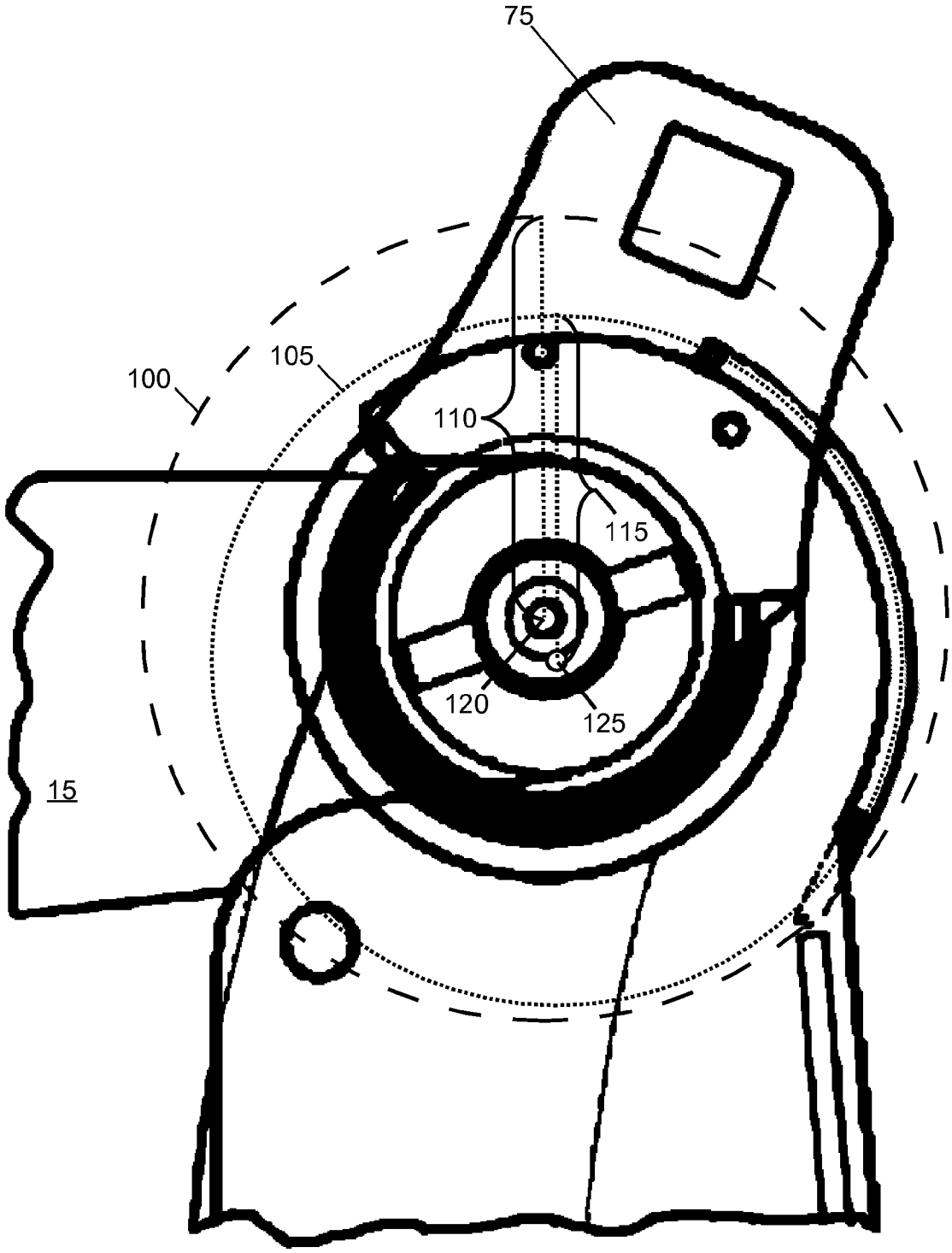
FIG. 12 shows a side view of the center points of the rotation/curvature and the radius of rotation/curvature for both a hand-operable locking clevis and a grind sheet on the vehicle bracket.

FIG. 12 show the arc of rotation 100 of the hand-operable locking clevis 75 and the exterior curvature 105 of the bracket extended to show the clevis radius of curvature 110 and the bracket radius of curvature 115. Also shown are the clevis rotation center point 120 and the bracket curvature center point 125. Although the arc and curvature are similar, they are slightly offset so that as the locking clevis is rotated clockwise in the picture, the grind bar of the clevis is pressed against the grind plate or exterior curvature of the bracket. Further clockwise rotation of the clevis will further tighten the clevis.

While the clevis radius of curvature and the bracket radius of curvature may be equal, their respective center points must be offset.

Figure 14:
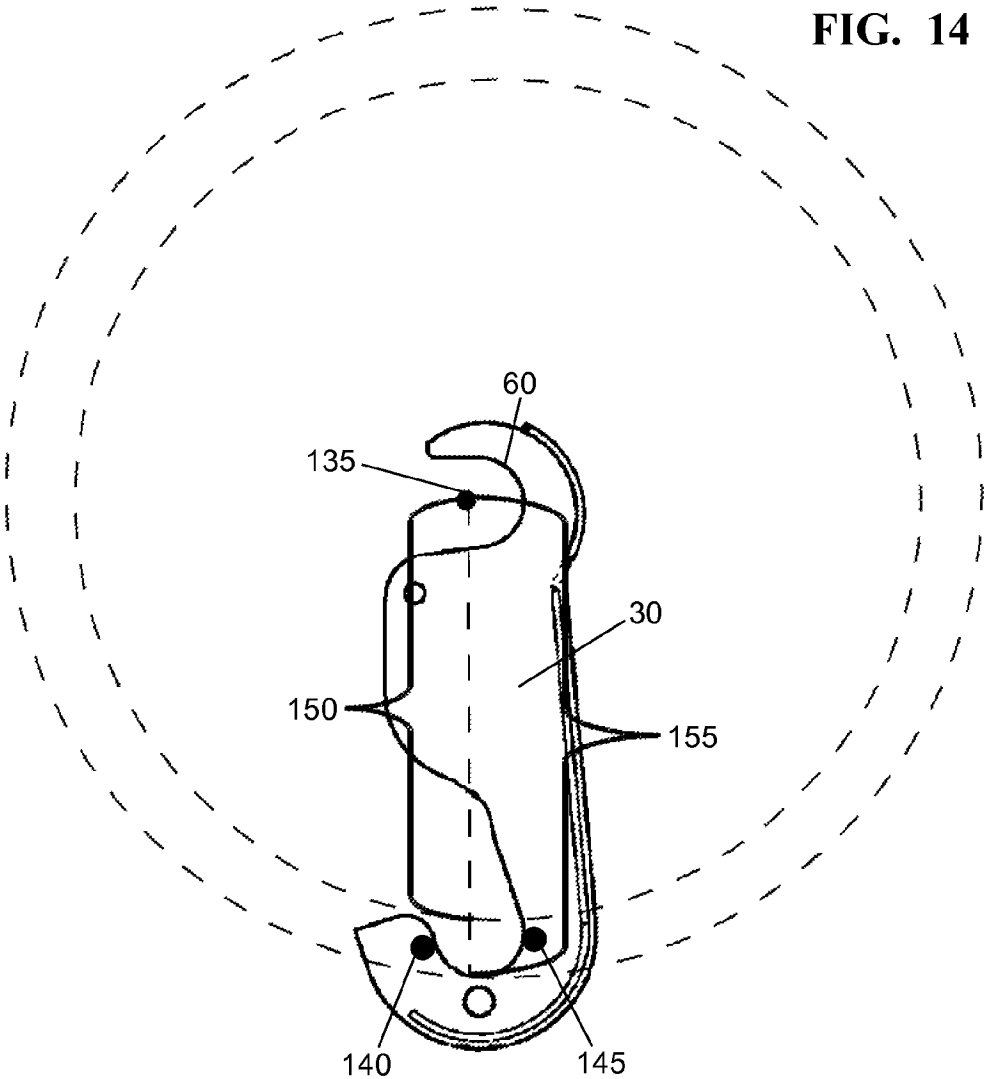
FIG. 14 shows a side view of a bracket highlighting two distant portions of a lower pocket for flanking a lower pin, wherein each of the portions is separated from the middle of the upper pocket by a distance between (a) the pin separation distance plus one half the height of the upper pin and (b) the pin separation distance plus one half of the height of the upper pin plus the height of the lower pin.
Figure 13:
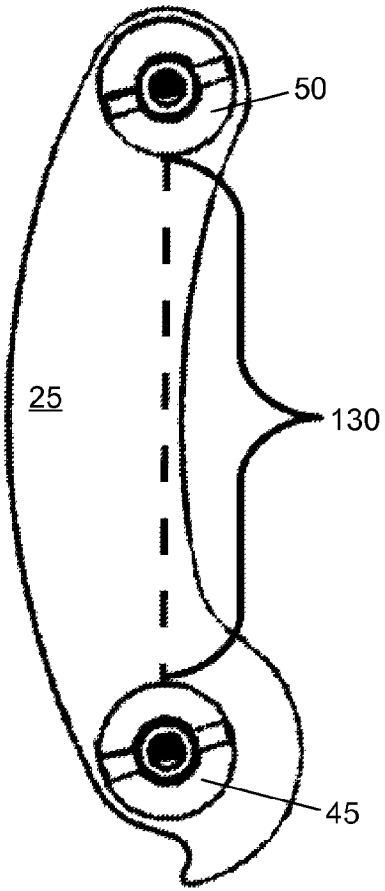
FIG. 13 shows a side view of a tower highlighting the separation of the pins.

FIG. 13 shows a tower 25 with an upper pin 50 and a lower pin 45 separated by a pin separation distance 130. The tower of FIG. 13 is structured to be secured into the bracket of FIG. 14. The tower is constructed from a substantially rigid material such as metal or a high-strength composite material such that the pin separation distance 130 is not significantly alerted when a the lift arm assembly is utilized. In FIG. 14, the bracket has an upper pocket 60 with a center point 135. The lower pocket 55 has a primarily horizontal opening, and a first portion 140 and a second portion 145 of the lower pocket are structured to flank, and thereby secure, a seated lower pin in the lower pocket. Due to the rigid tower, and the two flanking portions, the lower pin cannot be removed from the lower pocket while the upper pin is seated in the upper pocket. The two flanking portions are located on opposite sides of the lower pocket (in order to flank the lower pin) and are each spaced from the center point of the upper pocket by between $$H_{UP}/2+S_{P1\&P2} \leq S_{P\&UPC} \leq H_{UP}/2+S_{P1\&P2}+H_{LP}$$

wherein $H_{UP}/2$ is one half of the height of the upper pin, $S_{P1\&P2}$ is the pin separation as shown in FIG. 1, $S_{P\&UPC}$ is the separation of the portion and the center of upper pocket center, $H_{LP}$ is the height of the lower pin. In FIG. 14, a first distance 150 is equal to $H_{UP}/2+S_{P1\&P2}$ and a second distance 155 is equal to $H_{UP}/2+S_{P1\&P2}+H_{LP}$.

The center points of the pockets are herein defined to be aligned with the hinge when the pin is seated and secured within the pocket. The height of the pin is herein defined to be twice the distance from the center point of the pocket to the edge of the pocket when measured along a straight line (in a vertical plane) extending from the center point of the lower pocket to the center point of the upper pocket.

Figure 16:
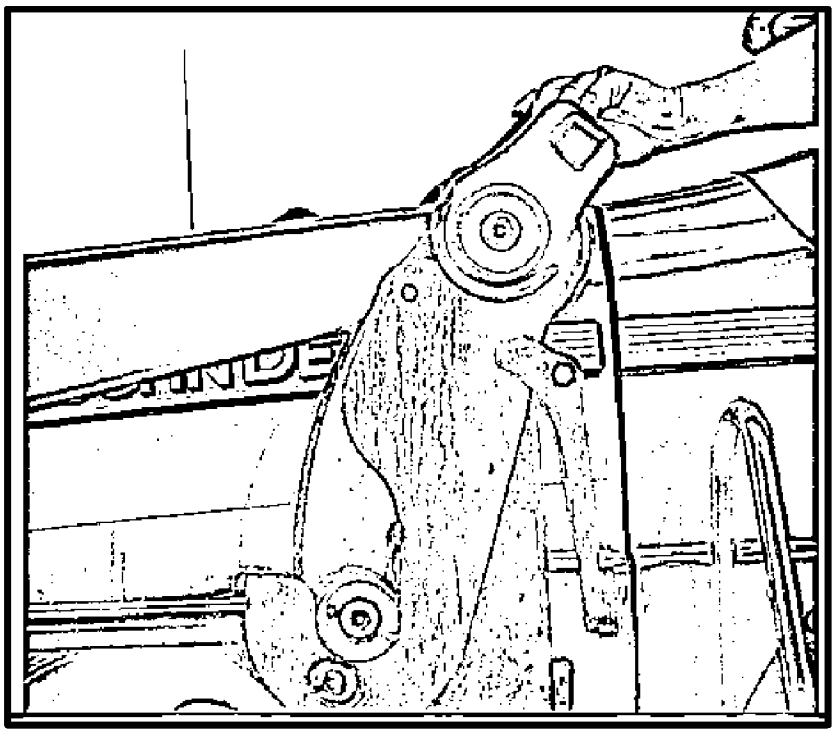
FIG. 16 shows a "second rotating the locking clevis forward to unlock the tower from the bracket" step in a method for disconnecting lift arms from a vehicle.
Figure 15:
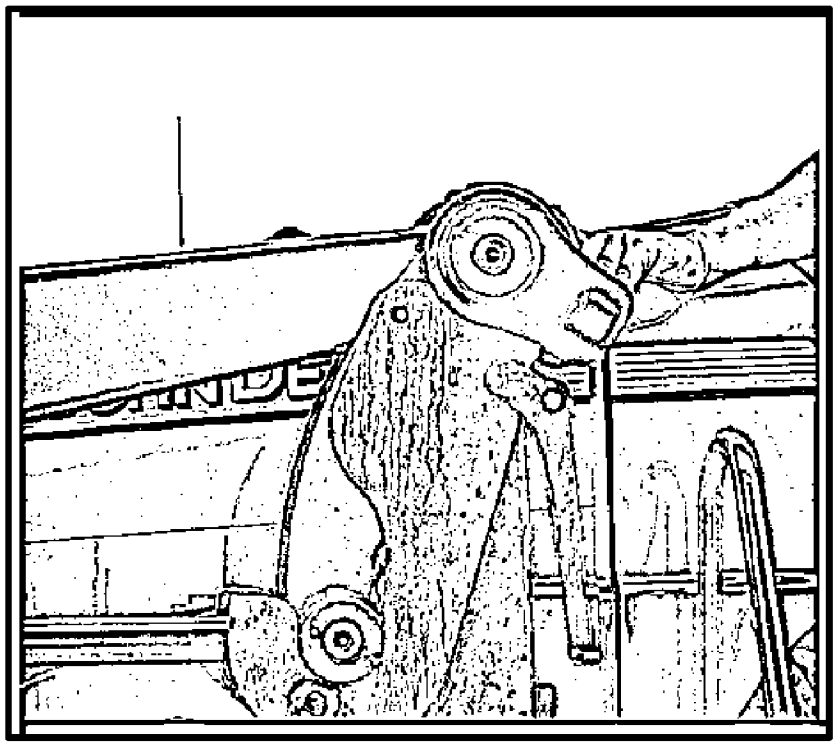
FIG. 15 shows a "first rotating the locking clevis forward to unlock the tower from the bracket" step in a method for disconnecting lift arms from a vehicle.
Figure 18:
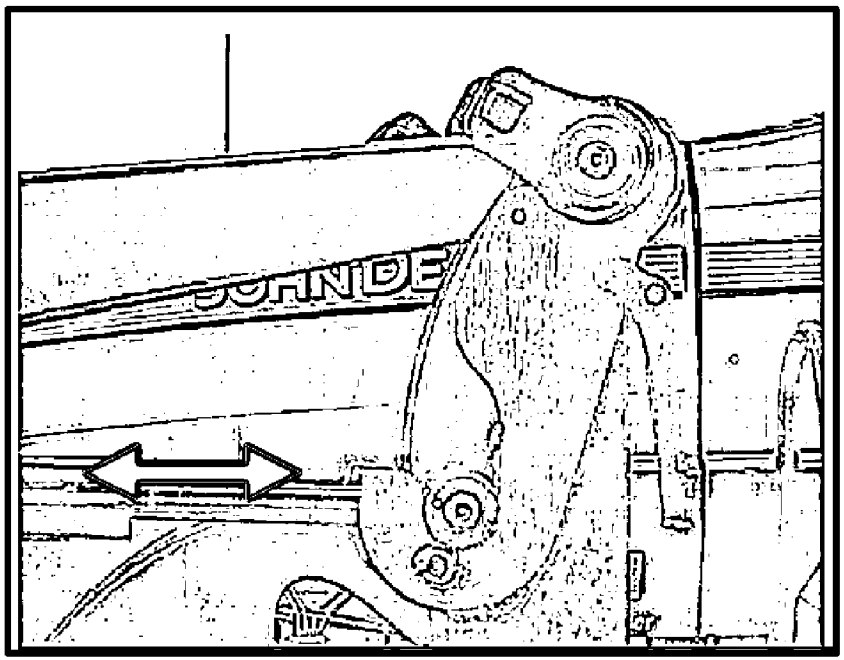
FIG. 18 shows an "extending the lift cylinder of the loader arm" step in a method for disconnecting lift arms from a vehicle.
Figure 17:
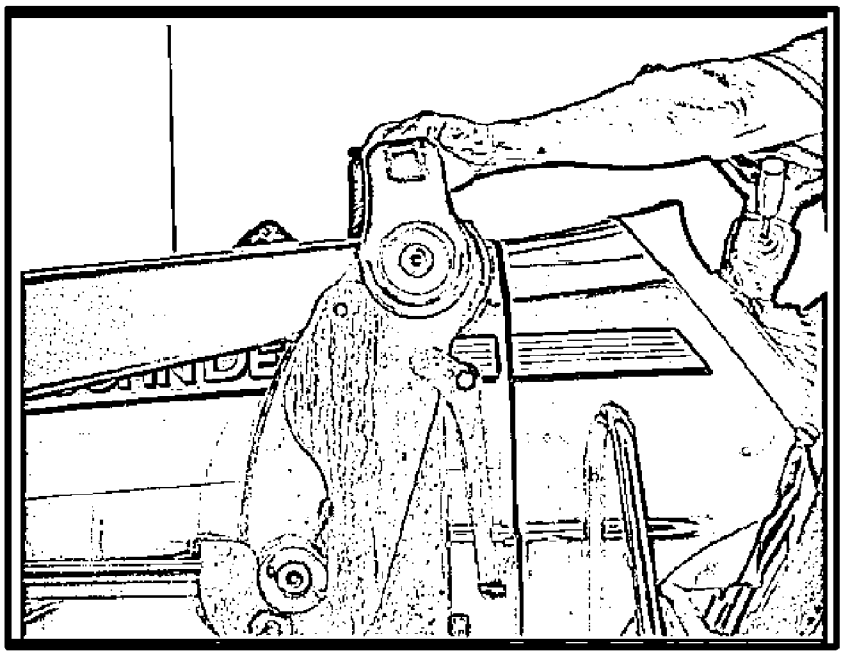
FIG. 17 shows a "third rotating the locking clevis forward to unlock the tower from the bracket" step in a method for disconnecting lift arms from a prime mover.
Figure 20:
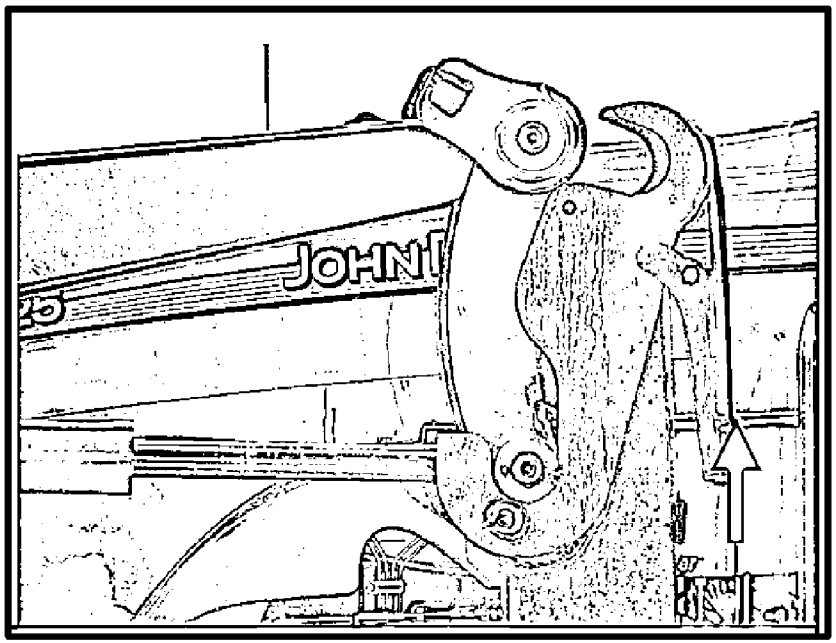
FIG. 20 shows an "extending the lift cylinder until the top pin clears the mounting bracket" step in a method for disconnecting lift arms from a vehicle.
Figure 19:
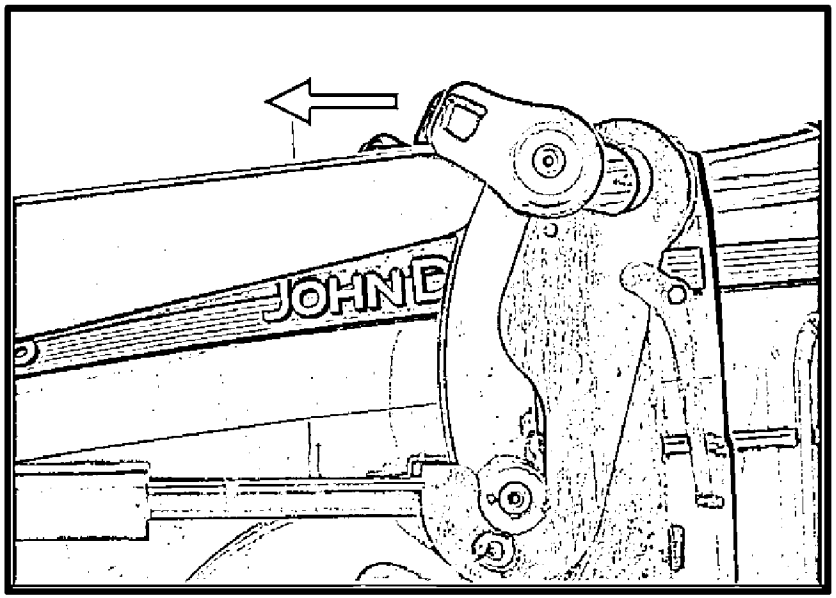
FIG. 19 shows a "moving the top pin forward" step in a method for disconnecting lift arms from a vehicle.
Figure 22:
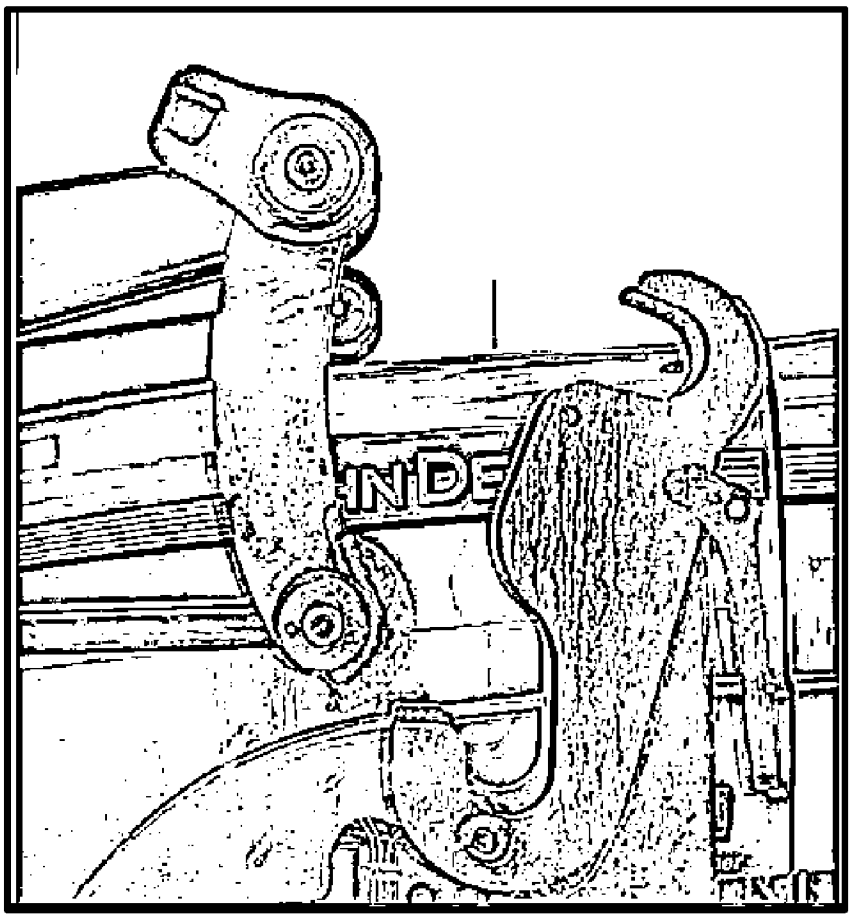
FIG. 22 shows an "unhooking the fluid conduit manifold an backing away" step in a method for disconnecting lift arms from a vehicle.
Figure 21:
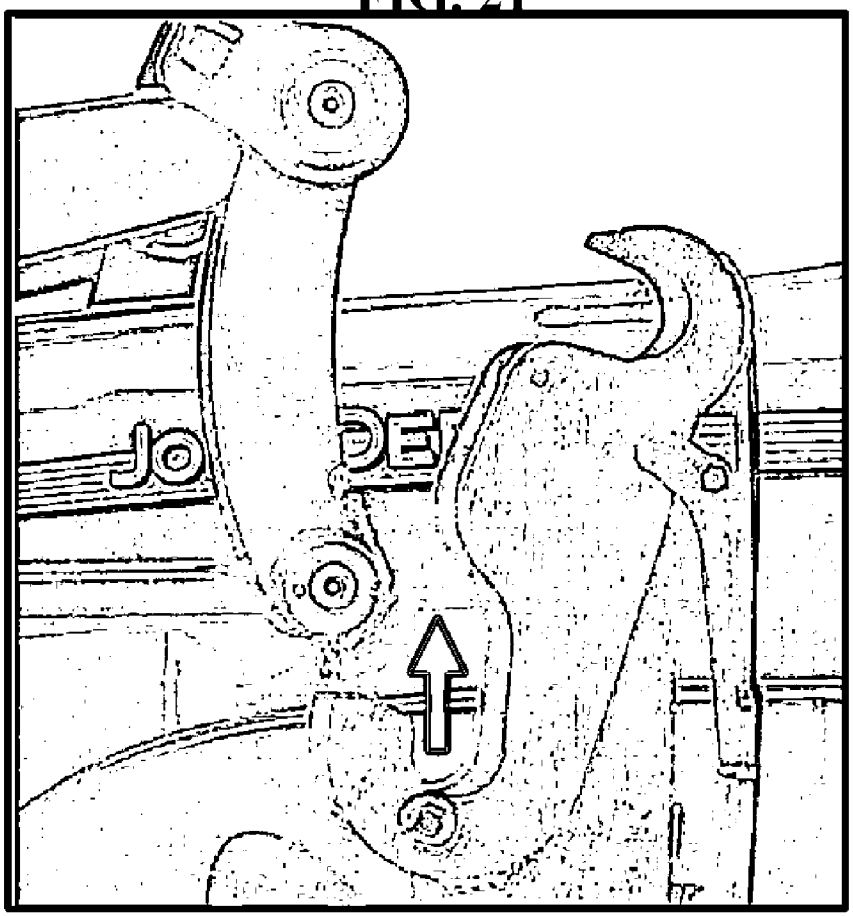
FIG. 21 shows an "engaging the bucket cylinder to raise the back of the tower out of the mounting bracket" step in a method for disconnecting lift arms from a vehicle.

FIGS. 15 through 22 illustrate a method for detaching lift arms from a vehicle or prime mover. FIGS. 15 through 17 illustrate an operator moving the locking clevis of the tower from a locked to an unlocked orientation. The locking clevis is structured so that the operator may unlock the clevis by hand. FIG. 18 shows extending the actuator of the loader arm to remove the top hinge/pin of the tower from the top pocket of the bracket as seen in FIG. 19. The further extension of the cylinders acts to move the top hinge/pin further out of the pocket, and once the top hinge/pin is out of the pocket, the bottom hinge/pin moves up and out of the pocket as seen in FIGS. 21 and 22. Although the tower and bracket are not connected in FIGS. 21 and 22, hydraulic lines still connect the vehicle to the cantilevered bucket/arm assembly such that the loader operator may raise or lower the arms. The assembly may be returned to the operational configuration by performing the steps of FIGS. 15-22 in reverse.

Figure 23:
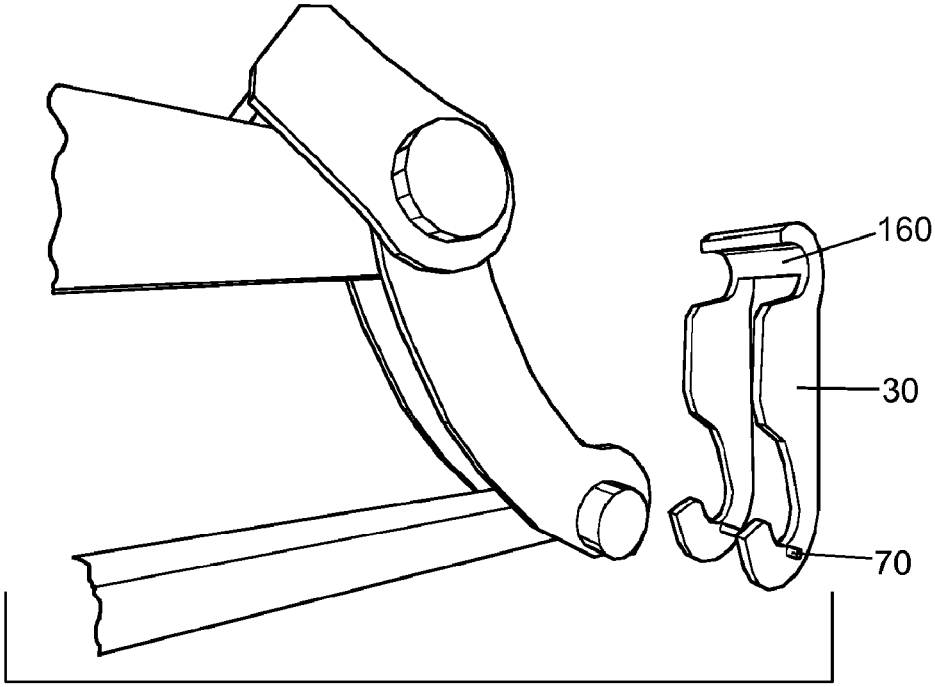
FIG. 23 shows a side perspective view of a coupling disconnected from an adapter wherein the coupling has a reinforced hook/pocket structured to wrap around a top pin of the coupling.

FIG. 23 illustrates an example of an assembly where the upper pocket of the bracket includes an upper reinforcement plate 160 extending between two halves of the vehicle bracket 30 and around the upper pocket 60. The reinforcement plate 160 may include features such as divots or canals structured to seat the parallel plates of the tower shown in FIG. 23. The additional features may assist in keeping the tower seated in the pockets of the bracket while an operator secures the tower with the hand-operable locking clevis. For the lower pin and pocket, the locking bar 70 provides support to the two parallel plates of the bracket around the lower pocket.

Figure 24:
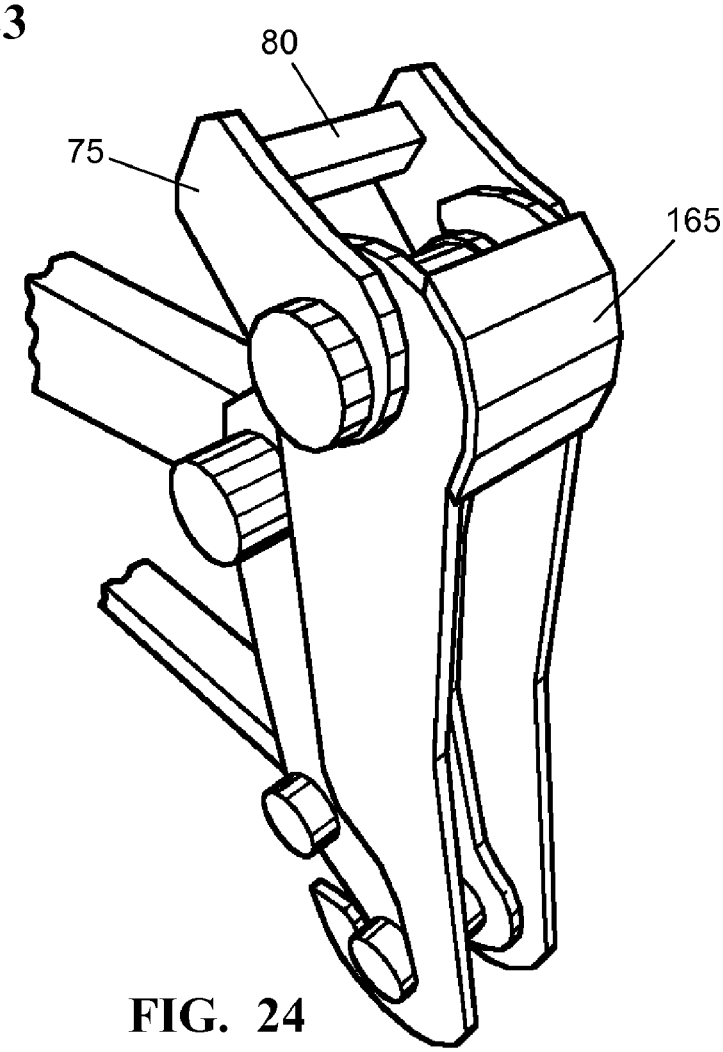
FIG. 24 shows a rear perspective view of a tower disconnected from a bracket wherein the tower includes a grind plate adapted to scrape against a grind bar of the tower to frictionally secure the locking clevis around the hook/pocket region of the bracket.

FIG. 24 illustrates an example of a tower and bracket assembly with a detachable grind sheet 165 secured to the bracket and structured to rub against a grind bar 80 of the locking clevis. The detachable grind sheet may be structured to have a semi-elastic wear surface such as rubber, neoprene, plastic, or wood for rubbing against a substantially inelastic and resilient metal or ceramic grind bar such that the wear on the grind bar is minimized. Features for installing the detachable grind sheet may include screws, bolts, adhesives, and other fasteners.

FIGS. 25 through 27 illustrate a tower and bracket assembly having an extended tower 170 and an extended bracket 175 wherein the upper hinge 40 of the tower is separated from the upper pin 50, and the lower hinge 35 of the extended tower is separated from the lower pin 45. The locking clevis of the extended tower rotates about the upper pin 50 so that it may be secured to the extended bracket 175. The extended assembly provides a simplified connection of the lift arms 15 and lift cylinder 20 or actuator that may be removed from the assembly while the extended tower is seated and secured to the extended bracket. Additionally, the increased separation of the pockets reduces the forces exerted on the locking clevis by increasing leverage. As seen in FIGS. 26 and 27, a locking bar 70 may connect the lower pockets of the extended bracket 175, and as shown in FIG. 26, a detachable grind sheet 165 may be secured to the extended bracket 175.

Figure 28:
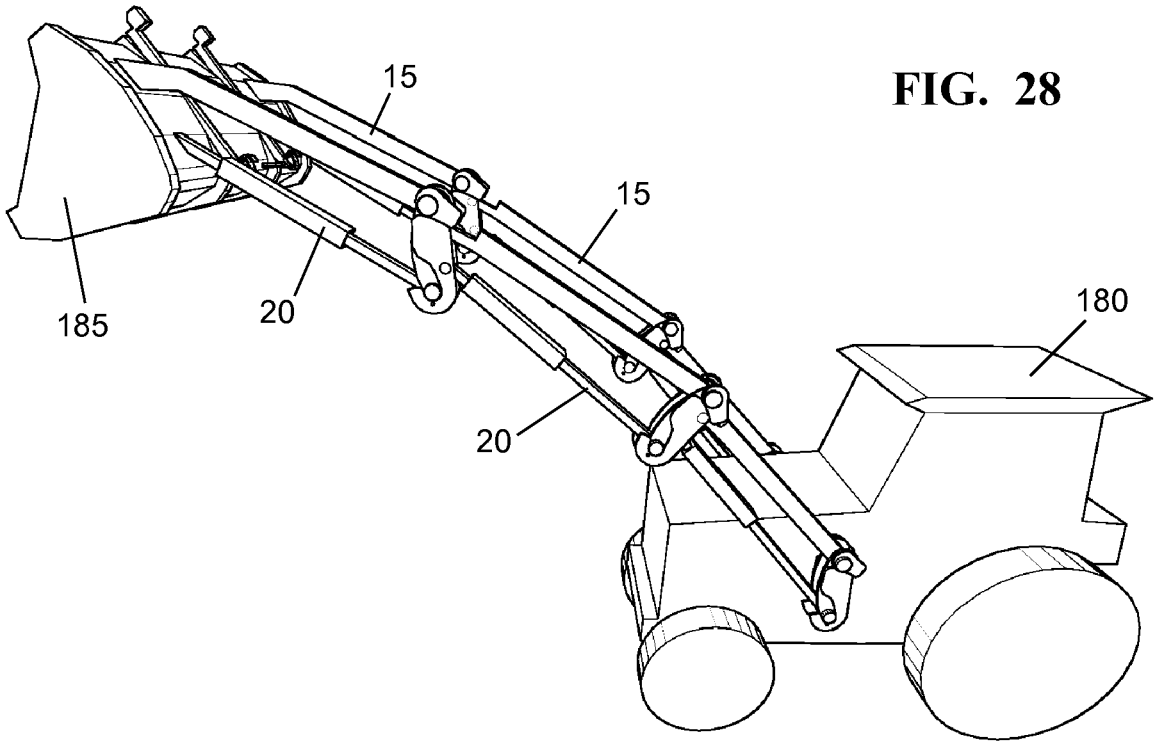
FIG. 28 shows a side view of a vehicle selectively secured to a bucket implement via a multiple tower and bracket assemblies.
Figure 29:
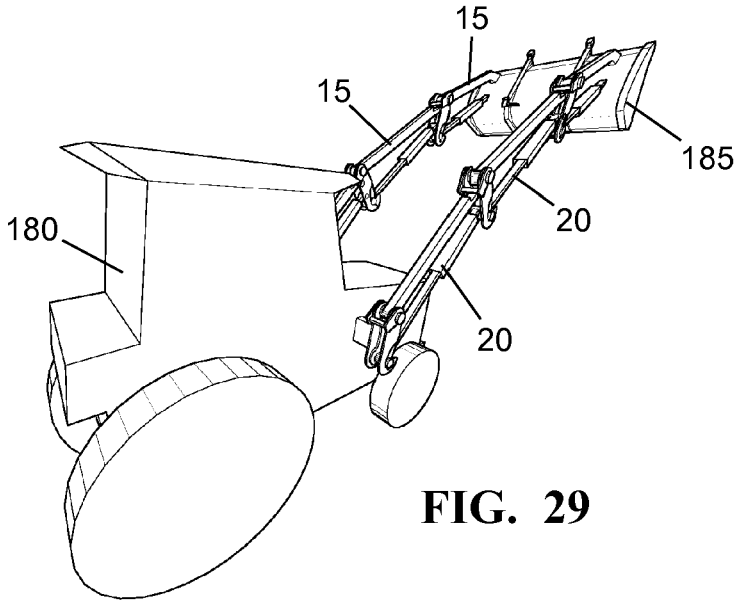
FIG. 29 shows a rear perspective view of a vehicle selectively secured to a bucket implement via a multiple tower and bracket assemblies.

In FIGS. 28 and 29 a vehicle 180 is connected to a bucket implement 185 via a plurality of hand-operable tower/bracket (adapter/coupling) assemblies, lift arms 15, and lift cylinders 20 or actuators. In alternate embodiments of the invention, a single pair of connection assemblies may be used to connect an implement to a prime mover via two lifting arms, however multiple arms may be interconnected depending on the required task.

In FIGS. 1-29, the pockets of the tower/bracket assemblies have been located on the brackets while the pins and locking devises have been located on the tower. In FIGS. 30-32 an alternate configuration is shown with upper tower pockets 190, lower tower pockets 195, and a grind sheet 165 located on the tower. The locking clevis, upper pin, and lower pin are located on the bracket. By positioning the pins and locking clevis on the bracket, the number of moving parts on the tower is reduced.

Figure 33:
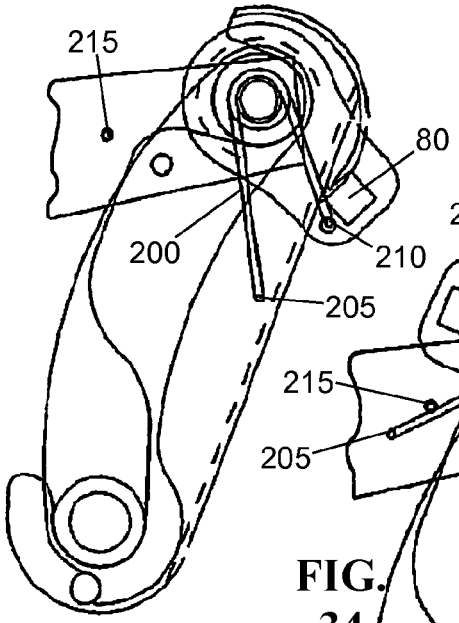
FIG. 33 shows a side view of a connector assembly with a spring wrapped around the upper pin of the tower.
Figure 34:
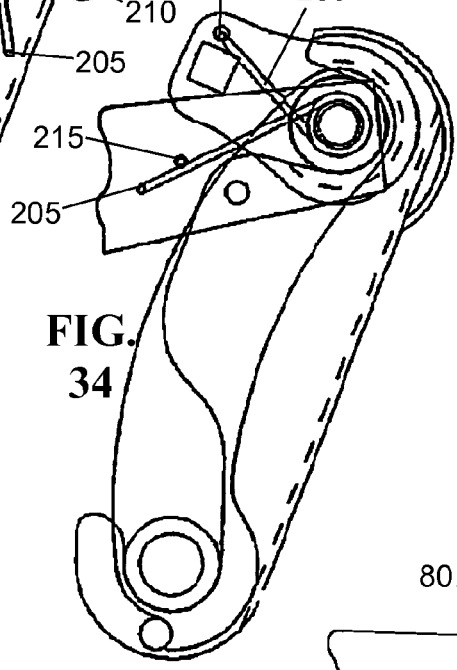
FIG. 34 shows a side view of a spring acting to keep a locking clevis unsecured to a vehicle.

During operation of the lifting arms, the weight of the grind bar may cause the locking clevis to tighten beyond what an operator can loosen. Generally, the operator must overcome a force greater than the product of the force pressing the pin into the pocket multiplied by the static coefficient of friction between the grind plate/sheet and the grind bar. FIGS. 33 through 37 illustrate examples of a spring 200 coiled around the upper pin 50 of a tower to keep the locking clevis in an unlocked orientation, or to assist an operator in rotating the U-shaped locking clevis from a locked orientation to a unlocked orientation. In FIG. 33, the spring 200 has a first end 205 that is unsupported while the spring is in a relaxed configuration. The second end 210 of the spring is pressed against the grind bar 80 of the locking clevis. In FIG. 34, the locking clevis is kept in an unlocked configuration by a spring 200 with a first end 205 pressed against an arm dowel 215 extending horizontally from the lifting arm 15. The first end 205 of the spring rotates counter-clockwise about the upper pin in a transition from FIG. 33 to FIG. 34. As in FIG. 33, in FIG. 34 the second end 210 of the spring 200 is also pressed against the grind bar 80 of the locking clevis. Since the first end of the spring has been wrapped around the upper pin, the spring continually exerts a counter-clockwise force upon the locking clevis to keep the locking clevis in an unlocked configuration. While a vehicle operator is connecting a tower to a bracket, it is possible that the operator will unintentionally hit or jar the tower and cause the U-shaped locking clevis to rotate into a locked orientation that would prevent the upper pin from seating in the upper pocket. The addition of a spring helps to keep the clevis in an unlocked orientation and may reduce the amount of time needed to disconnect or reconnect the tower from the bracket.

Figure 35:
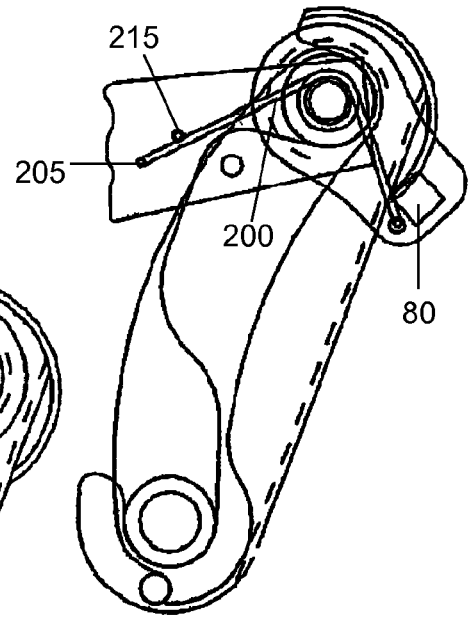
FIG. 35 shows a side view of a spring configured to help rotate a clevis, frictionally secured to a grind plate, from a locked configuration to an unlocked configuration.

FIG. 35 illustrates an example of a spring 200 in a configuration to assist an operator in rotating the clevis to a disconnected configuration. During the operation of the loader, the weight of the grind bar and clevis may cause the clevis to further tighten such that an operator is unable to move the clevis by hand. Vibrations of the upper pin within the upper pocket may also act to tighten the clevis. When the operator wishes to disconnect the tower from the bracket, they may rotate the first end of the spring such that the first end 205 exerts a clockwise force upon the arm dowel 215 while the second end 210 exerts a counter-clockwise force against the grind bar 80 shown in FIG. 35. With the assistance of the spring, the operator may then rotate the clevis by hand.

Figure 36:
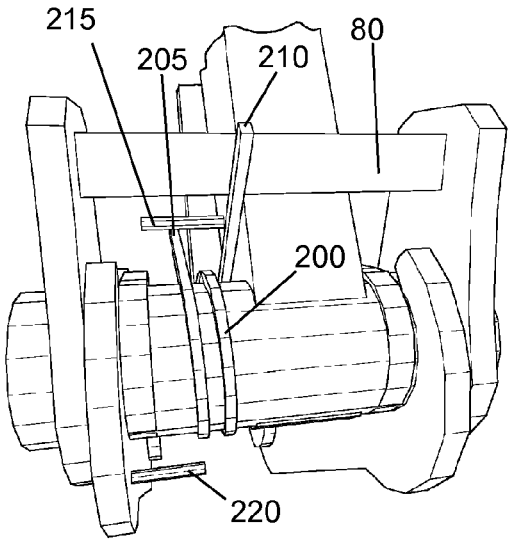
FIG. 36 shows a top perspective view of a spring acting to keep a locking clevis in an unlocked rotational configuration such that a boom tower, rotatably secured to the clevis, may be disconnected from a vehicle bracket.
Figure 37:
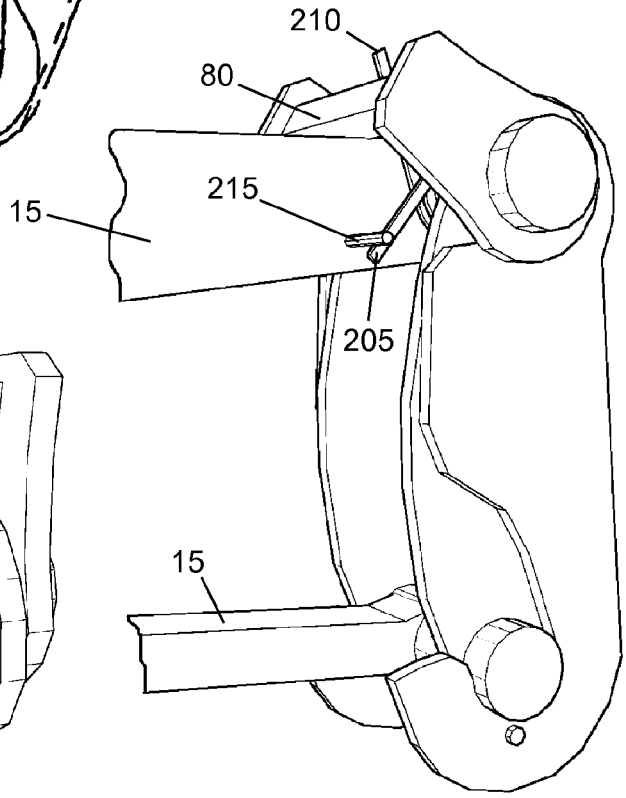
FIG. 37 shows a side perspective view of a spring acting to keep a locking clevis in an unlocked rotational configuration such that a boom arm tower, rotatably attached to the clevis, may be disconnected from a vehicle bracket.
Figure 38:
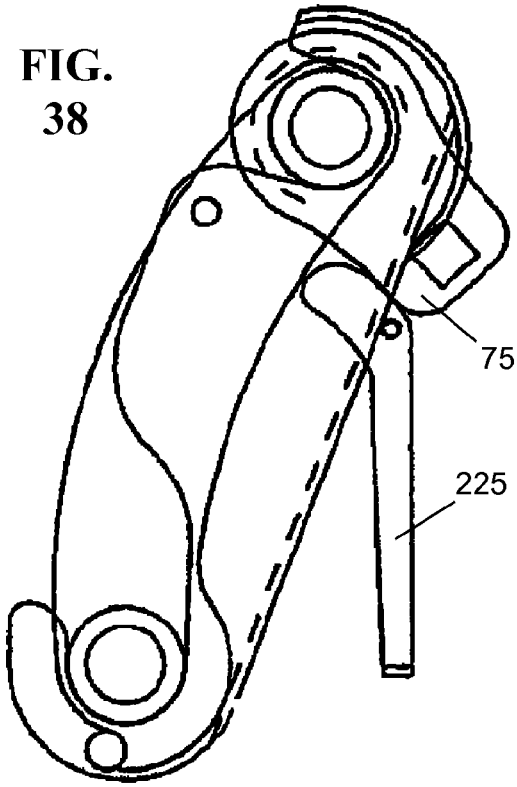
FIG. 38 shows a side view of a boom tower secured to a vehicle bracket by a locking clevis wherein the bracket has a lever to assist the rotation of the clevis from a highly tightened locked state to an unlocked state.
Figure 39:
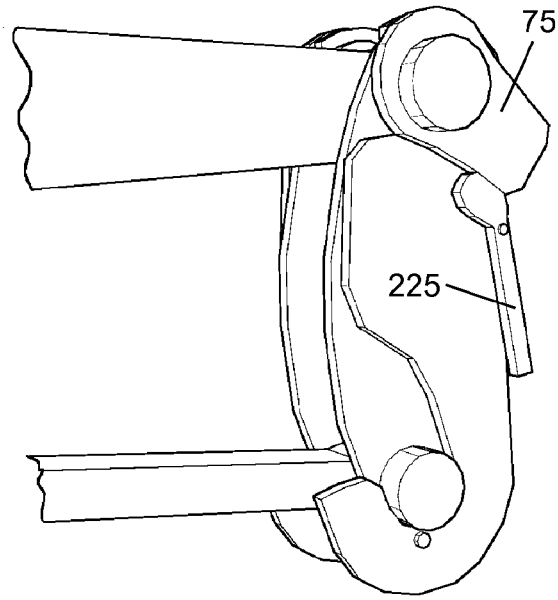
FIG. 39 shows a side perspective view of a boom tower secured to a vehicle bracket by a locking clevis wherein the bracket has a rotation arm to assist the rotation of the clevis from a locked state to an unlocked state.

FIGS. 36 and 37 show perspective views of a spring 200 securing a locking clevis in an unlocked configuration while the tower is seated, but not secured to a bracket. In FIG. 36 is shown a bracket dowel 220 located such that the spring may be positioned to assist in rotating the clevis from an unlocked orientation to a locked orientation.

Figure 40:
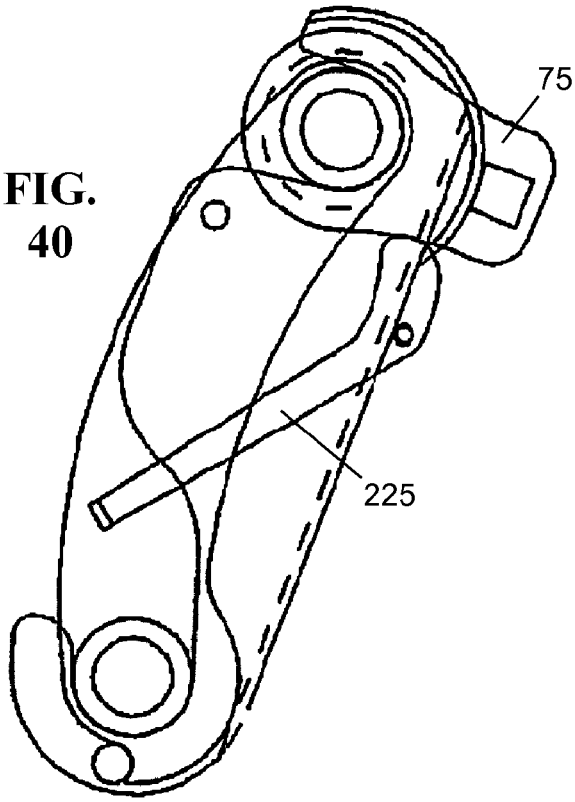
FIG. 40 shows a side view of a boom tower and a bracket, wherein the bracket has a lever assisting the rotation of the clevis from a locked state to an unlocked state.
Figure 41:
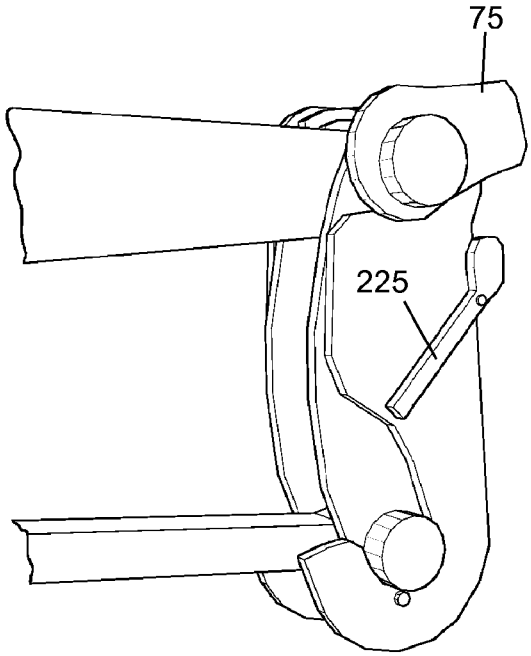
FIG. 41 shows a side perspective view of a lifting arm tower seated in, but unsecured to a bracket, wherein the bracket has a lever to assist the unlocking of a clevis on the tower.
Figure 45:
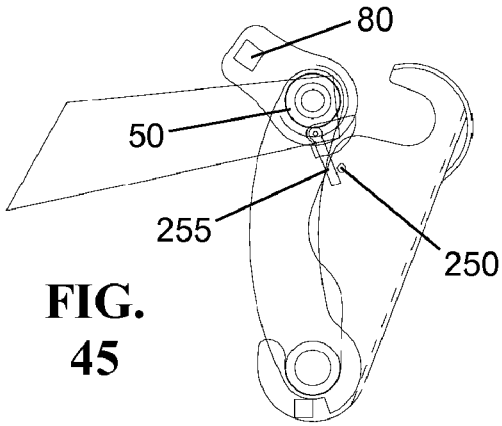
FIG. 45 shows a hand operable locking clevis with an auto-lock structure in a fully unlocked configuration.
Figure 46:
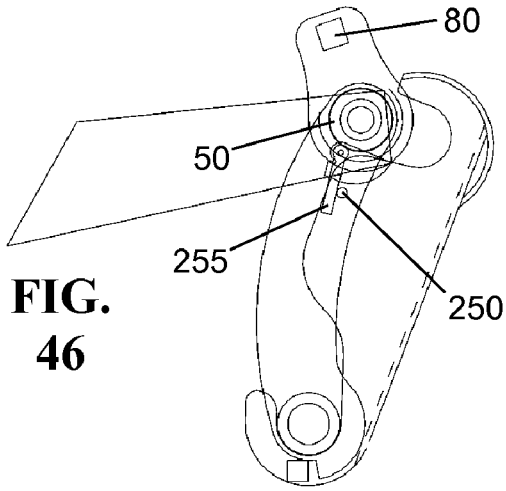
FIG. 46 shows a hand operable locking clevis with an auto-lock structure rotating a clevis from a fully unlocked configuration.
Figure 47:
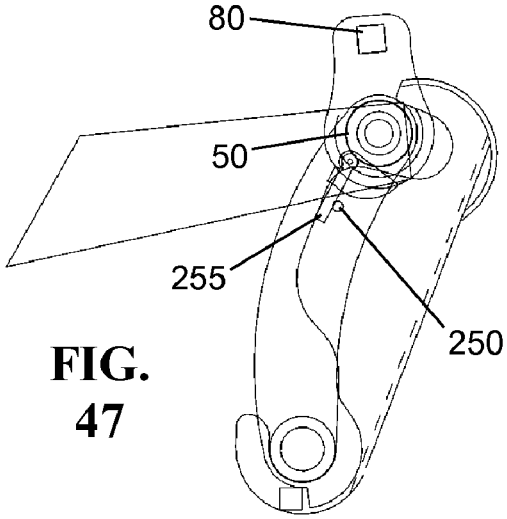
FIG. 47 shows a hand operable locking clevis with an auto-lock structure continuing to rotate the clevis.
Figure 48:
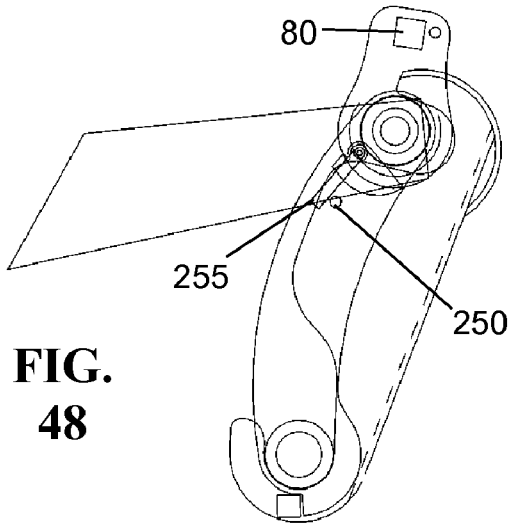
FIG. 48 shows a hand operable locking clevis with an auto-lock structure wherein the top pin of the tower is nearly seated in the pocket of the bracket.

FIGS. 38 through 41 show a tower and bracket assembly with a lever 225 rotatably (or hingeably) secured to the bracket and structured to rotate the locking clevis 75 from a locked configuration to a somewhat less locked configuration. Since the weight of the grind bar causes the clevis to tighten as the vehicle uses the lift arms, the clevis may tighten to a configuration where an operator is unable to loosen the clevis by hand. The use of leverage allows the operator to apply a substantial amount of force to the clevis when the clevis is in a locked configuration. Once the clevis has been loosened (as shown in FIGS. 40 and 41) the operator is able to hand rotate the clevis to a fully unlocked configuration.

FIGS. 42 through 44 illustrate an example of a locking clevis 75 that includes a torque bar 230 for providing additional leverage when an operator wishes to tighten or loosen the locking clevis. The torque bar 230 may move from a storage configuration shown in FIGS. 42 and 44 to an operational configuration shown in FIG. 43. In the storage configuration, the torque bar is pressed against or near the U-shaped locking clevis to reduce the likelihood of the torque bar being damaged while the lifting arms are in use by a vehicle. In the operational configuration, the torque bar extends away from the center of the upper pin to maximize the amount of torque that an operator may exert upon the clevis without utilizing additional tools.

FIGS. 45 through 50 illustrate an example of a hand-operable clevis with an auto-lock structure that automatically rotates the clevis into a locked position as the upper pin 50 of the tower is seated in the upper pocket of the bracket. The bracket includes knob 250 and the clevis includes a handle 255 generally located in the opposite side of the pin as the grind bar 80. The handle is rotationally locked relative to the grind bar about the upper pin such that when the knob presses the lever outward from the upper pocket, the grind bar is rotated towards the upper pocket. In the illustrated example, both handle and the grind bar are rotated clockwise about the upper pin as the handle is pressed against the knob. Alternate mechanisms for automatically locking the clevis around the vehicle bracket may also be used. For example, the outer lip of the upper pocket may be constructed to rotate the clevis as the upper pin passes into the upper pocket. In yet another embodiment, the auto-lock mechanism may pre-tension a spring, similar to the one illustrated in FIGS. 33-37, that may be utilized to help an operator unlock an over-tightened clevis. In that embodiment, the auto-lock mechanism may include a ratcheting surface or other activation device to prevent the spring from unintentionally loosening the clevis.

Figure 49:
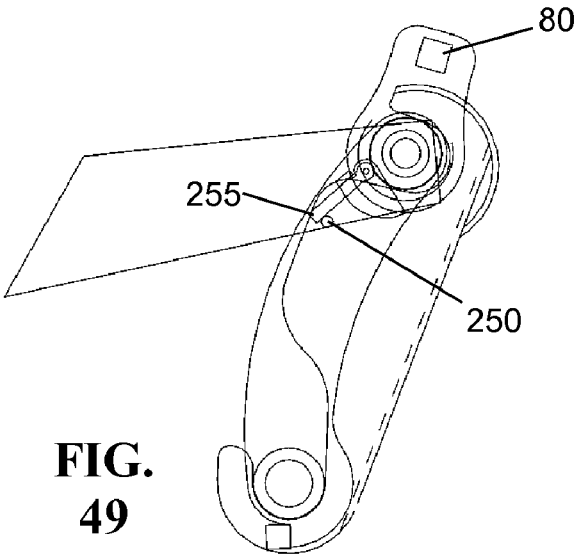
FIG. 49 shows a hand operable locking clevis with an auto-lock structure wherein the top pin of the tower is fully seated in the pocket of the bracket.
Figure 50:
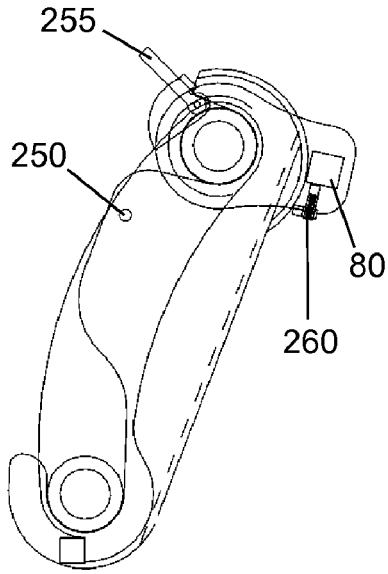
FIG. 50 shows a hand operable locking clevis with an auto-lock structure wherein the top pin of the tower is fully seated in the pocket of the bracket and the weight of the clevis is rotating the clevis into a fully locked position.

FIG. 49 shows the upper pin fully seated in the upper pocket of the bracket. From FIGS. 48 to 49 the knob has rotated the handle enough such that the grind bar 80 has moved past its highest position with respect to the upper pin. After passing the zenith, the weight of the grind bar continues to rotate the clevis clockwise to a fully locked orientation. FIG. 50 shows a set screw 260 contacting the grind bar 80 and preventing the locking clevis from further tightening. The set screw is adjustable so that an operator can select how tightly locked. In an exemplary embodiment, the set screw is positioned to stop the clevis rotation at a position where clevis is unlockable by hand while the tower is unweighted from the bracket, but securely locked to the bracket when the weight of the tower is supported by the bracket. By lowering the implement and lifting arms into the ground, the tower may be unweighted from the bracket so that the locking clevis may be unlocked by hand.

Other alterations, variations, and combinations are possible that fall within the scope of the present invention. Although the preferred embodiments of the present invention have been described, those skilled in the art will recognize other modifications that may be made that would nonetheless fall within the scope of the present invention. Therefore, the present invention should not be limited to the apparatus and method described. Instead, the scope of the present invention should be consistent with the invention claimed below.

We claim:

1. An assembly for securing a boom to a vehicle, the assembly comprising:

a bracket secureable to the vehicle, the bracket including
- a hook with
  - a hook width,
  - an exterior curvature, and
  - a curved grind plate extending perpendicular to the exterior curvature;

a tower
- hingeably attachable to the boom and
- hingeably attached to a hydraulic cylinder, a U-shaped clevis for securing the tower to the bracket, the U-shaped clevis having a grind bar having a length longer than the hook width,
- a first rotor separated from a second rotor, and
- each rotor hingeabley attached to the tower and secured to the grind bar;

the U-shaped clevis rotatable about the tower to a first state wherein a portion of the hook is surrounded by the combination of the first rotor, the second rotor, the tower, and the grind bar and the grind bar is separated from the grind plate;

the U-shaped clevis rotatable about the tower to a second state wherein the grind bar is ground against the grind plate to
- secure the tower to the bracket, and
- lock the clevis in the second state.

2. The assembly of claim 1 wherein the bracket includes a first pocket, the tower includes a first pin structured to be seated in the first pocket, and the hook forms a portion of the first pocket.

3. The assembly of claim 2 further comprising:

the U-shaped clevis rotatable about the tower to a third state, wherein in the second rotational state, the clevis bar pulls the first pin into the first pocket with a first force, in the third rotational state, the grind bar pulls the first pin into the first pocket with a second force, wherein the second force is larger then the first force.

4. The assembly of claim 3 wherein a barrier force larger than a product of the second force and the coefficient of friction between the grind bar and the grind sheet must be overcome to rotate the U-shaped clevis from the third state to the second.

5. The assembly of claim 1 wherein the bracket includes a first pocket, and the hook forms a portion of the first pocket;

the tower includes a first pin;

the U-shaped clevis rotates about the first pin;

the first pin seats in the pocket, and the seated first pin is locked in the first pocket when the U-shaped clevis is the second state.

6. The assembly of claim 1 wherein the bracket includes a first pocket and the hook forms a portion of the first pocket;

the tower is hingeably attached to the boom at a first hinge;

the U-shaped clevis rotates about the first hinge;

the first hinge seats in the pocket, and the seated first hinge is locked in the first pocket when the U-Shaped clevis is the second state.

7. The assembly of claim 1 wherein the grind plate is an integral part of the hook.

8. The assembly of claim 1 wherein the grind plate includes a wear surface comprising a semi-elastic material.

9. The assembly of claim 1 wherein the tower includes a first pin and a second pin separated by a separation distance, the bracket includes a first pocket receiving and seating the first pin, the hook forming a portion of the first pocket, and a second pocket receiving and seating the second pin;

the U-shaped clevis rotates about the first pin, and the second pocket includes a first portion and a second portion, the portions flanking the seated second pin, wherein each of the first and second portion is located on an arc having a center point at the center of the first pocket and a radius longer than the separation distance plus one half of the height of the first pin, and shorter than the separation distance plus one half of the height of the first pin plus one half of the height of the second pin.

10. An assembly for selectively disconnecting a loader arm from a vehicle, the assembly comprising:

the loader arm, a hydraulic cylinder, a tower, and a bracket secured to the vehicle;

the loader arm rotatably attached to the tower at an arm hinge;

the hydraulic cylinder rotatably attached to the tower at a cylinder hinge and to the loader arm at a lifting hinge;

the tower including a first pin and a second pin, each pin secured to the tower and having a height equal to twice the vertical distance from the center of the pin to the edge of the pin, wherein one of the first or second pins is located above the other of the first or second pins, and the first and second pins are separated by a separation distance; the bracket having a grind portion and structured to be secured to the tower via the first and second pins, the bracket including a first pocket with a first opening for receiving and seating the first pin, a second pocket with a second opening for receiving and seating the second pin, the second pocket is structured with a first and second portion flanking the second pin when seated, wherein the first and second portion is each located about an arc having a center point at the center of the first pocket and a radius longer than the separation distance plus one half of the height of the first pin, and shorter than the separation distance plus one half of the height of the first pin plus one half of the height of the second pin; and a hand-operable locking clevis with a first rotor hingeably attached to the tower and a grind bar extending from the first rotor, the locking clevis, the grind bar pressing against the grind portion of the bracket to secure the first pin in the first pocket.

11. The assembly of claim 10 wherein the first opening is orientated substantially perpendicular to the second opening.

12. The assembly of claim 10 wherein the hand-operable locking clevis rotates about the center of the first pocket when the first pin is seated in the first pocket.

13. The assembly of claim 10 wherein the bracket includes a locking bar located about the perimeter of the second pocket and extending away from the second pocket the tower includes a clasp located near the second pin, structured to lock onto the locking bar of the bracket, and rotationally locked about the second pin relative to the first pin.

14. The assembly of claim 10 wherein the bracket includes a guide region for guiding the second pin of the tower into the second pocket of the bracket, and the guide region is located between the first pocket and the second pocket.

15. The assembly of claim 10 wherein the first pin is located at and extends from the arm hinge of the tower the second pin is located at and extends from the cylinder hinge.

16. The assembly of claim 10 wherein the grind portion of the bracket is a grind plate;

the bracket includes a hook with a hook width and an exterior curvature including the grind plate;

the hand-operable locking clevis includes a U-shaped lock for securing the tower to the bracket, the U-shaped lock having the grind bar having a width longer than the hook width, the first rotor separated from a second rotor, each rotor extending from a first end hingeably attached to the tower and a second end secured to the grind bar, wherein the U-shaped lock in a first rotation state about the tower surrounds the hook with the first rotor, the second rotor, the tower, and the grind bar and the grind bar is separated from the grind plate;

wherein the U-shaped lock further rotates to a second rotation state about the tower frictionally grinds the locking grind bar against the grind plate to secure the tower to the bracket.

17. The assembly of claim 10 wherein the grind portion of the bracket is a curved grind plate;

the first opening is orientated substantially perpendicular to the second opening;

the hand-operable locking clevis rotates about the center of the first pocket;

the bracket includes a hook with a hook width and an exterior curvature including the curved grind plate;

the hand-operable locking clevis includes a U-shaped lock for securing the tower to the bracket, the U-shaped lock including the grind bar having a width longer than the hook width, the first rotor separated from a second rotor, each rotor extending from a first end hingeabley attached to the tower and a second end secured to the grind bar, wherein the U-shaped lock in a first rotation state about the tower surrounds the hook with the first rotor, the second rotor, the tower, and the grind bar and the grind bar is separated from the grind plate, and wherein the U-shaped lock further rotates to a second rotation state about the tower frictionally grinds the locking grind bar against the grind plate to secure the tower to the bracket;

the bracket includes a locking bar located about the perimeter of the second pocket and extending away from the second pocket;

the tower includes a clasp located near the second pin, and structured to lock onto the bar of the bracket;

the bracket includes an indented guide region for guiding the second pin of the tower into the second pocket of the bracket, the guide region located between the first pocket and the second pocket; and the first pin is located at and extends from the arm hinge of the tower, and the second pin is located at and extends from the cylinder hinge.

18. A tractor, skid steer, construction device or vehicle comprising:

a prime mover;

an adapter secured to the prime mover;

an arm having a first end and a second end, the first end of the arm rotatably secured to a coupling and the second end of the arm connected to an implement;

an actuator for raising and lowering the arm and the implement, the actuator having a first and second end, the first end of the actuator rotatably secured to the coupling, and the second end of the actuator rotatably secured to the arm;

a connection assembly comprising the adapter selectively secured to the coupling, the connection assembly including:

a first pin located in a first pocket, the first pocket having a pocket width;

a hand-operable locking clevis including a first rotor and a second rotor, each rotor secured to the first pin and rotatable about the first pin;

a grind bar distant from the first pin and having a length greater than the pocket width, the grind bar secured to both the first and second rotors, and latchable around the first pocket to secure the first pin within the first pocket;

a curved grind plate wrapping around the first pocket, the curved grind plate frictionally secured to the grind bar to keep the hand-operable locking clevis in a locked configuration; and a second pin, distant from the first pin, located in a second pocket.

19. The tractor, skid steer, construction device or vehicle of claim 18 wherein the actuator is secured to the coupling at a first hinge, the arm is secured to the coupling at a second hinge, the first pin is secured to and extends from one of the first or second hinges, and the second pin is secured to and extends from the other of the first or second hinges.

20. The tractor, skid steer, construction device or vehicle of claim 18 further comprising the curved grind plate has a first curvature;

an inner surface of the grind bar rotates, about the first pin, with a second curvature;

wherein the radius of the second curvature is greater than the radius of the first curvature.

21. The tractor, skid steer, construction device or vehicle of claim 18 further comprising the curved grind plate has a first curvature;

the grind bar rotates, about the first pin, with a second curvature;

wherein the center point of the first curvature is offset from the center point of the second curvature.

22. The tractor, skid steer, construction device or vehicle of claim 18 wherein the first pin is from the second pin by a separation distance;

each pin having a height equal to twice the vertical distance from the center of the pin to the edge of the pin, the second pocket is includes a first and second portion flanking the second pin, wherein the first and second portion is each located about an arc having a center point at the center of the first pocket and a radius longer than the separation distance plus one half of the height of the first pin, and shorter than the separation distance plus one half of the height of the first pin plus one half of the height of the second pin.

23. The tractor, skid steer, construction device or vehicle of claim 18 wherein the connection assembly further includes a locking fastner rotatably secured about the second pin, located adjacent to the second pocket, and rotationally locked about the second pin relative to the first pin;

a bar secured to the perimeter of the second pocket and extending parallel to the axis of rotation of the locking fastner; the bar and locking fastener and latch positioned such that when the bar and locking fastener are always interconnected when the first pin is seated in the first pocket, and the second pin is seated in the second pocket.

* * * * *